US008791929B2

(12) United States Patent
Kimura

(10) Patent No.: US 8,791,929 B2
(45) Date of Patent: Jul. 29, 2014

(54) DRIVING METHOD OF SEMICONDUCTOR DEVICE

(71) Applicant: Semiconductor Energy Laboratory Co., Ltd., Atsugi (JP)

(72) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 13/647,469

(22) Filed: Oct. 9, 2012

(65) Prior Publication Data

US 2013/0033470 A1 Feb. 7, 2013

Related U.S. Application Data

(63) Continuation of application No. 12/396,846, filed on Mar. 3, 2009, now Pat. No. 8,305,304.

(30) Foreign Application Priority Data

Mar. 5, 2008 (JP) ..... 2008-054545

(51) Int. Cl.
*G09G 5/00* (2006.01)

(52) U.S. Cl.
USPC ..... 345/205; 345/204; 345/76

(58) Field of Classification Search
CPC ..... G09G 5/00
USPC ..... 345/205
See application file for complete search history.

(56) References Cited

U.S. PATENT DOCUMENTS

| | | | |
|---|---|---|---|
| 6,847,341 | B2 | 1/2005 | Kimura et al. |
| 7,173,590 | B2 | 2/2007 | Uchino et al. |
| 7,187,351 | B2 | 3/2007 | Kwon |
| 7,414,599 | B2 | 8/2008 | Chung et al. |
| 7,429,985 | B2 | 9/2008 | Kimura et al. |
| 7,714,813 | B2 | 5/2010 | Uchino et al. |
| 7,804,469 | B2 | 9/2010 | Asano |
| 8,085,226 | B2 | 12/2011 | Kimura |

(Continued)

FOREIGN PATENT DOCUMENTS

| | | |
|---|---|---|
| CN | 1581273 A | 2/2005 |
| CN | 1799081 A | 7/2006 |

(Continued)

OTHER PUBLICATIONS

Chinese Office Action (Application No. 200910128516.3) dated Mar. 22, 2013, with Full English Translation.

*Primary Examiner* — Quan-Zhen Wang
*Assistant Examiner* — David Lee
(74) *Attorney, Agent, or Firm* — Fish & Richardson P.C.

(57) ABSTRACT

The semiconductor device includes a transistor and a capacitor element which is electrically connected to a gate of the transistor. Charge held in the capacitor element according to total voltage of voltage corresponding to the threshold voltage of the transistor and image signal voltage is once discharged through the transistor, so that variation in current flowing in the transistor or mobility of the transistor can be reduced.

6 Claims, 13 Drawing Sheets

(56) References Cited

U.S. PATENT DOCUMENTS

| | | | | |
|---|---|---|---|---|
| 2003/0090481 | A1 | 5/2003 | Kimura | |
| 2004/0227749 | A1 | 11/2004 | Kimura | |
| 2007/0103419 | A1 | 5/2007 | Uchino et al. | |
| 2007/0115225 | A1 | 5/2007 | Uchino et al. | |
| 2007/0120795 | A1 | 5/2007 | Uchino et al. | |
| 2007/0132694 | A1 | 6/2007 | Uchino et al. | |
| 2007/0159417 | A1 | 7/2007 | Miyake | |
| 2007/0164962 | A1 | 7/2007 | Uchino et al. | |
| 2007/0210720 | A1 | 9/2007 | Kimura | |
| 2007/0247398 | A1 | 10/2007 | Nathan et al. | |
| 2007/0262978 | A1 * | 11/2007 | Kimura | 345/215 |
| 2007/0268210 | A1 | 11/2007 | Uchino et al. | |
| 2009/0009676 | A1 | 1/2009 | Kimura et al. | |
| 2012/0086061 | A1 | 4/2012 | Kimura | |

FOREIGN PATENT DOCUMENTS

| | | | |
|---|---|---|---|
| EP | 1 465 141 | A1 | 10/2004 |
| EP | 1632930 | A1 | 3/2006 |
| JP | 2003-043995 | A | 2/2003 |
| JP | 2003-202833 | A | 7/2003 |
| JP | 2003-216110 | A | 7/2003 |
| JP | 2004-310014 | A | 11/2004 |
| JP | 2005-031630 | A | 2/2005 |
| JP | 2005-345722 | A | 12/2005 |
| JP | 2007-148128 | A | 6/2007 |
| JP | 2007-148129 | A | 6/2007 |
| JP | 2007-310311 | A | 11/2007 |
| JP | 2008-032770 | A | 2/2008 |
| JP | 2008-039875 | A | 2/2008 |
| WO | WO 2006/060902 | A1 | 6/2006 |

* cited by examiner

DRIVING METHOD OF SEMICONDUCTOR DEVICE

CROSS-REFERENCE TO RELATED APPLICATIONS

This application is a continuation of U.S. application Ser. No. 12/396,846, filed Mar. 3, 2009, now allowed, which which claims the benefit of a foreign priority application filed in Japan as Serial No. 2008-054545 on Mar. 5, 2008, both of which are incorporated by reference.

BACKGROUND OF THE INVENTION

1. Field of the Invention

The present invention relates to a semiconductor device or a driving method thereof.

2. Description of the Related Art

Flat panel displays such as liquid crystal displays (LCD) become widely used in recent years. However, the LCD has various drawbacks such as narrow viewing angle, narrow chromaticity range, slow response speed, and the like. Thus, as a display which overcomes those drawbacks, research of an organic EL (also referred to as an electroluminescence, an organic light-emitting diode, an OLED, or the like) display becomes active (see Patent Document 1).

However, the organic EL display has a problem that current characteristics of a transistor for controlling current which flows to an organic EL element vary by pixels. When the current flowing to an organic EL element (in other words, current flowing to a transistor) varies, luminance of the organic EL element also varies, whereby a display screen displays an image with unevenness. Thus, a method for compensating variation in threshold voltage of a transistor is examined (Patent Documents 2 to 6).

However, even if variation in threshold voltage of a transistor is compensated, variation in mobility of a transistor also leads to variation in current flowing to an organic EL element, so that image unevenness occurs. Thus, a method for compensating not only the threshold voltage of a transistor but also variation in mobility is examined (Patent Documents 7 and 8).

[Patent Document 1] Japanese Published Patent Application No. 2003-216110

[Patent Document 2] Japanese Published Patent Application No. 2003-202833

[Patent Document 3] Japanese Published Patent Application No. 2005-31630

[Patent Document 4] Japanese Published Patent Application No. 2005-345722

[Patent Document 5] Japanese Published Patent Application No. 2007-148129

[Patent Document 6] PCT International Publication No. 2006/060902

[Patent Document 7] Japanese Published Patent Application No. 2007-148128 (paragraph 0098)

[Patent Document 8] Japanese Published Patent Application No. 2007-310311 (paragraph 0026)

SUMMARY OF THE INVENTION

However, in technology disclosed in Patent Documents 7 and 8, while an image signal (video signal) is input in a pixel, mobility of a transistor is compensated. Therefore, various problems are caused.

For example, since variation in mobility of a transistor is compensated while an image signal is input in a pixel, an image signal cannot be input to another pixel during the period. Usually, the number of the pixels, the number of frame frequencies, screen size, or the like determines the maximum value of the period for inputting the image signal to each pixel (so-called, one gate selection period or one horizontal period). Therefore, if the period for compensating variation in mobility increases in one gate selection period, periods of other processes (input of an image signal or acquisition of the threshold voltage) decreases. Therefore, various processes are needed in one gate selection period in a pixel. As a result, accurate processes cannot be performed because of lack of process time, or compensation of mobility is insufficient because the period for compensation of variation in mobility is insufficient.

Further, one gate selection period per one pixel becomes shorter as the number of the pixels and frame frequencies increase, or as the screen size increases. Therefore, input of an image signal to the pixel, compensation of variation in mobility, or the like cannot be performed sufficiently.

Alternatively, in the case where variation in mobility is compensated while an image signal is input, compensation of variation in mobility is easily influenced by distortion of waveform of the image signal. Therefore, the level of compensation of mobility varies between the cases where distortion of waveform of the image signal is large and where distortion of waveform of the image signal is small. Accordingly, accurate compensation is impossible.

Alternatively, when variation in mobility is compensated while an image signal is input to a pixel, it is difficult to perform a dot sequential driving in many cases. In the dot sequential driving, when an image signal is input to a pixel of a given row, an image signal is input to the pixel one by one rather than to all pixels of the row at the same time. Thus, the length of the period for inputting an image signal is different from each pixel. Therefore, when variation in mobility is compensated while an image signal is input, the length of the period for compensating variation in mobility is different from each pixel, so that the amount of compensation also differs from each pixel. Thus, compensation is not performed normally. Therefore, variation in mobility is compensated while an image signal is input in a pixel, the line sequential driving is needed in which a signal is input to all pixels of the row at the same time, not the dot sequential driving.

Furthermore, when a line sequential driving is performed, the structure of a source signal line driver circuit (also referred to as a video signal line driver circuit, a source driver, and a data driver) is complicated compared with the case where the dot sequential driving is performed. For example, for the source signal line driver circuit in the line sequential driving, a DA converter, an analog buffer, a latch circuit, and the like are needed in many cases. However, the analog buffer includes an operational amplifier, a source follower circuit, or the like in many cases and is easily influenced by variation in current characteristics of a transistor. Thus, when a circuit is configured using a TFT (a thin film transistor), a circuit compensating variation in current characteristics of a transistor is necessary. Accordingly, the scale of a circuit and power consumption increase. Therefore, when a TFT is used as a transistor for a pixel portion, there is a possibility that it is difficult to form the pixel portion and the signal line driver circuit over the same substrate. Therefore, the signal line driver circuit is necessarily to be formed by using a different means from that of the pixel portion. Thus, cost may rise. Furthermore, the pixel portion and the signal line driver circuit are necessarily to be connected using COG (chip on glass), TAB (tape automated bonding), or the like, so that generation of a contact failure, decrease of the reliability, or the like occurs.

Through the above description, an object is to provide a device in which influence of variation in threshold voltage of a transistor is reduced or a driving method thereof. Alternatively, another object is to provide a device in which influence of variation in mobility of a transistor is reduced or a driving method thereof. Alternatively, another object is to provide a device in which influence of variation in current characteristics of a transistor is reduced or a driving method thereof. Alternatively, another object is to provide a device in which a long input period of an image signal is obtained or a driving method thereof. Alternatively, another object is to provide a device in which a long compensation period to reduce the influence of variation in threshold voltage is obtained or a driving method thereof. Alternatively, another object is to provide a device in which a long compensation period to reduce the influence of variation in mobility is obtained or a driving method thereof. Alternatively, another object is to provide a device which is not easily influenced by a distortion of waveform of an image signal or a driving method thereof. Alternatively, another object is to provide a device which can perform not only the line sequential driving but also the dot sequential driving or a driving method thereof. Alternatively, another object is to provide a device in which a pixel and a driver circuit can be formed on the same substrate or a driving method thereof. Alternatively, another object is to provide a device which is low power consumption or a driving method thereof. Alternatively, another object is to provide a device which is low cost or a driving method thereof. Alternatively, another object is to provide a device which has a low possibility that a contact failure at a connection portion of wirings occurs or a driving method thereof. Alternatively, another object is to provide a highly reliable device or a driving method thereof. Alternatively, another object is to provide a device which includes a large number of pixels or a driving method thereof. Alternatively, another object is to provide a device of which frame frequency is high or a driving method thereof. Alternatively, another object is to provide a device of which panel size is large or a driving method thereof. Other than these objects, an object is to provide a better device or a driving method thereof using various means.

The semiconductor device includes a transistor and a capacitor element which is electrically connected to a gate of the transistor. Charge held in the capacitor element according to total voltage of voltage corresponding to the threshold voltage of the transistor and image signal voltage is once discharged through the transistor, so that variation in current flowing in the transistor or mobility of the transistor can be reduced.

One exemplary mode of the present invention is a method for driving a semiconductor device which includes a transistor and a capacitor element electrically connected to a gate of the transistor, and includes steps of holding a charge in the capacitor element according to a total voltage of a voltage corresponding to a threshold voltage of the transistor and an image signal voltage; and discharging the charge held in the capacitor element through the transistor.

Another exemplary mode of the present invention is a method for driving a semiconductor device which includes a transistor, a display element, and a wiring. A connection between one of a source and a drain of the transistor and a gate of the transistor is conducting; a connection between the other of the source and the drain of the transistor and the wiring is conducting; and a connection between the one of the source and the drain of the transistor and the display element is nonconducting in a first period. The connection between the one of the source and the drain of the transistor and the gate of the transistor is nonconducting; the connection between the other of the source and the drain of the transistor and the wiring is conducting; and the connection between the one of the source and the drain of the transistor and the display element is conducting in a second period.

Another exemplary mode of the present invention is a method for driving a semiconductor device which includes a transistor, a display element, a first wiring, and a second wiring. A connection between one of a source and a drain of the transistor and a gate of the transistor is conducting; a connection between the other of the source and the drain of the transistor and the first wiring is conducting; a connection between the other of the source and the drain of the transistor and the second wiring is nonconducting; and a connection between the one of the source and the drain of the transistor and the display element is nonconducting in a first period. The connection between the one of the source and the drain of the transistor and the gate of the transistor is nonconducting; the connection between the other of the source and the drain of the transistor and the first wiring is conducting; the connection between the other of the source and the drain of the transistor and the second wiring is nonconducting; and the connection between the one of the source and the drain of the transistor and the display element is conducting in a second period.

Another exemplary mode of the present invention is the method for driving a semiconductor device which includes a transistor and a capacitor element electrically connected to a gate of the transistor. A total voltage of a voltage corresponding to a threshold voltage of the transistor and an image signal voltage is held in the capacitor element in a first period. A charge held in the capacitor element according to the total voltage in the first period is discharged through the transistor in a second period.

Another exemplary mode of the present invention is a method for driving a semiconductor device which includes a transistor, a capacitor element electrically connected to a gate of the transistor, and a display element. A total voltage of a voltage corresponding to the threshold voltage of the transistor and an image signal voltage is held in the capacitor element in a first period. A charge held in the capacitor element in the first period according to the total voltage is discharged through the transistor in a second period. Current is supplied to the display element through the transistor in a third period.

Another exemplary mode of the present invention is a method for driving a semiconductor device which includes a transistor and a capacitor element electrically connected to a gate of the transistor. A first voltage is held in the capacitor element and a connection between one of a source and a drain of the transistor and a display element is nonconducting in a first period. A second voltage is held in the capacitor element and the connection between the one of the source and the drain of the transistor and the display element is conducting in a second period. The first voltage is higher than the second voltage.

Another exemplary mode of the present invention is a method for driving a semiconductor device which includes a transistor, a first switch for controlling whether a connection between a first wiring and one of a source and a drain of the transistor is conducting or nonconducting, a second switch for controlling whether a connection between a second wiring and one of the source and the drain of the transistor is conducting or nonconducting, a third switch for controlling whether a connection between the other of the source and a drain of the transistor and the gate of the transistor is conducting or nonconducting, and a fourth switch for controlling whether a connection between the other of the source and the drain of the transistor and a display element is conducting or nonconducting. The first switch and the third switch are conducting, and the second switch and the fourth switch are nonconducting in a first period. The first switch and the fourth switch are conducting and the second switch and the third switch are conducting in a second period.

Another exemplary mode of the present invention is a method for driving a semiconductor device which includes a transistor, a first switch for controlling whether a connection between a first wiring and one of a source and a drain of the transistor is conducting or nonconducting, a second switch for controlling whether a connection between a second wiring and one of the source and the drain of the transistor is conducting or nonconducting, a third switch for controlling whether a connection between the other of the source and a drain of the transistor and the gate of the transistor is conducting or nonconducting, and a fourth switch for controlling whether a connection between the other of the source and the drain of the transistor and a display element is conducting or nonconducting. The second switch and the third switch are conducting, and a connection between the first switch and the fourth switch are nonconducting in a first period. The first switch and the third switch are conducting, and the second switch and the fourth switch are nonconducting in a second period. The first switch and the fourth switch are conducting, and the second switch and the third switch are nonconducting in a third period.

Note that various types of switches can be used as a switch. An electrical switch, a mechanical switch, and the like are given as examples. That is, any element can be used as long as it can control current flow, without limiting to a certain element. For example, a transistor (e.g., a bipolar transistor or a MOS transistor), a diode (e.g., a PN diode, a PIN diode, a Schottky diode, an MIM (metal insulator metal) diode, an MIS (metal insulator semiconductor) diode, or a diode-connected transistor), or the like can be used as a switch. Alternatively, a logic circuit combining such elements can be used as a switch.

An example of a mechanical switch is a switch formed using MEMS (micro electro mechanical system) technology, such as a digital micromirror device (DMD). Such a switch includes an electrode which can be moved mechanically, and operates by controlling connection and non-connection based on movement of the electrode.

In the case of using a transistor as a switch, polarity (a conductivity type) of the transistor is not particularly limited because it operates just as a switch. However, a transistor of polarity with smaller off-current is preferably used when off-current is to be suppressed. Examples of a transistor with smaller off-current are a transistor provided with an LDD region, a transistor with a multi-gate structure, and the like. Alternatively, it is preferable that an N-channel transistor be used when a potential of a source terminal which serves as a switch be closer to a potential of a low-potential-side power supply (e.g., Vss, GND, or 0 V), while a P-channel transistor be used when the potential of the source terminal is closer to a potential of a high-potential-side power supply (e.g., Vdd). This is because the absolute value of gate-source voltage can be increased when the potential of the source terminal is closer to a potential of a low-potential-side power supply in an N-channel transistor and when the potential of the source terminal is closer to a potential of a high-potential-side power supply in a P-channel transistor, so that the transistor can be operated more accurately as a switch. This is also because the transistor does not often perform a source follower operation, so that reduction in output voltage does not often occur.

Note that a CMOS switch may be used as a switch by using both N-channel and P-channel transistors. When a CMOS switch is used, the switch can more precisely operate as a switch because current can flow when either the P-channel transistor or the N-channel transistor is turned on. For example, voltage can be appropriately output regardless of whether voltage of an input signal to the switch is high or low. In addition, since a voltage amplitude value of a signal for turning on or off the switch can be made smaller, power consumption can be reduced.

Note that when a transistor is used as a switch, the switch includes an input terminal (one of a source terminal and a drain terminal), an output terminal (the other of the source terminal and the drain terminal), and a terminal for controlling conduction (a gate terminal). On the other hand, when a diode is used as a switch, the switch does not have a terminal for controlling conduction in some cases. Therefore, when a diode is used as a switch, the number of wirings for controlling terminals can be further reduced compared to the case of using a transistor as a switch.

Note that when it is explicitly described that "A and B are connected", the case where A and B are electrically connected, the case where A and B are functionally connected, and the case where A and B are directly connected are included therein. Here, each of A and B corresponds to an object (e.g., a device, an element, a circuit, a wiring, an electrode, a terminal, a conductive film, or a layer). Accordingly, another connection relation shown in drawings and texts is included without being limited to a predetermined connection relation, for example, the connection relation shown in the drawings and the texts.

For example, in the case where A and B are electrically connected, one or more elements which enable electric connection between A and B (e.g., a switch, a transistor, a capacitor, an inductor, a resistor, and/or a diode) may be connected between A and B. Alternatively, in the case where A and B are functionally connected, one or more circuits which enable functional connection between A and B (e.g., a logic circuit such as an inverter, a NAND circuit, or a NOR circuit; a signal converter circuit such as a DA converter circuit, an AD converter circuit, or a gamma correction circuit; a potential level converter circuit such as a power supply circuit (e.g., a dc-dc converter, a step-up dc-dc converter, or a step-down dc-dc converter) or a level shifter circuit for changing a potential level of a signal; a voltage source; a current source; a switching circuit; an amplifier circuit such as a circuit which can increase signal amplitude, the amount of current, or the like, an operational amplifier, a differential amplifier circuit, a source follower circuit, or a buffer circuit; a signal generating circuit; a memory circuit; and/or a control circuit) may be connected between A and B. For example, in the case where a signal output from A is transmitted to B even if another circuit is provided between A and B, A and B are connected functionally.

Note that when it is explicitly described that "A and B are electrically connected", the case where A and B are electrically connected (i.e., the case where A and B are connected by interposing another element or another circuit therebetween), the case where A and B are functionally connected (i.e., the case where A and B are functionally connected by interposing another circuit therebetween), and the case where A and B are directly connected (i.e., the case where A and B are connected without interposing another element or another circuit therebetween) are included therein. That is, when it is explicitly described that "A and B are electrically connected", the description is the same as the case where it is explicitly only described that "A and B are connected".

Note that a display element, a display device which is a device having a display element, a light-emitting element, and a light-emitting device which is a device having a light-emitting element can use various types and can include various elements. For example, a display medium, whose contrast, luminance, reflectivity, transmittivity, or the like changes by an electromagnetic action, such as an EL (electroluminescence) element (e.g., an EL element including organic and inorganic materials, an organic EL element, or an inorganic EL element), an LED (a white LED, a red LED, a green LED, a blue LED, or the like), a transistor (a transistor which emits light depending on current), an electron emitter, a liquid crystal element, electronic ink, an electrophoresis element, a grating light valve (GLV), a plasma display panel (PDP), a digital micromirror device (DMD), a piezoelectric ceramic display, or a carbon nanotube can be included as a display element, a display device, a light-emitting element, or a light-emitting device. Note that display devices using an EL element include an EL display; display devices using an electron emitter include a field emission display (FED), an SED-type flat panel display (SED: surface-conduction electron-emitter display), and the like; display devices using a liquid crystal element include a liquid crystal display (e.g., a transmissive liquid crystal display, a transflective liquid crystal display, a reflective liquid crystal display, a direct-view liquid crystal display, or a projection liquid crystal display); and display devices using electronic ink or an electrophoresis element include electronic paper.

Note that an EL element is an element having an anode, a cathode, and an EL layer interposed between the anode and the cathode. Note that as an EL layer, a layer utilizing light emission (fluorescence) from a singlet exciton, a layer utilizing light emission (phosphorescence) from a triplet exciton, a layer utilizing light emission (fluorescence) from a singlet exciton and light emission (phosphorescence) from a triplet exciton, a layer formed of an organic material, a layer formed of an inorganic material, a layer formed of an organic material and an inorganic material, a layer including a high-molecular material, a layer including a low molecular material, a layer including a low-molecular material and a high-molecular material, or the like can be included. Note that the present invention is not limited to this, and various EL elements can be included as an EL element.

Note that various types of transistors can be used as a transistor, without being limited to a certain type. For example, a thin film transistor (TFT) including a non-single-crystal semiconductor film typified by amorphous silicon, polycrystalline silicon, microcrystalline (also referred to as microcrystal, nanocrystal, semi-amorphous) silicon, or the like can be used. In the case of using the TFT, there are various advantages. For example, since the TFT can be formed at temperature lower than that of the case of using single crystal silicon, manufacturing cost can be reduced or a manufacturing apparatus can be made larger. Since the manufacturing apparatus is made larger, the TFT can be formed using a large substrate. Therefore, many display devices can be formed at the same time at low cost. In addition, a substrate having low heat resistance can be used because of low manufacturing temperature. Therefore, the transistor can be formed using a light-transmitting substrate. Accordingly, transmission of light in a display element can be controlled by using the transistor formed using the light-transmitting substrate. Alternatively, part of a film which forms the transistor can transmit light because the film thickness of the transistor is thin. Therefore, the aperture ratio can be improved.

Note that when a catalyst (e.g., nickel) is used in the case of forming polycrystalline silicon, crystallinity can be further improved and a transistor having excellent electric characteristics can be formed. Accordingly, a gate driver circuit (e.g., a scan line driver circuit), a source driver circuit (e.g., a signal line driver circuit), and/or a signal processing circuit (e.g., a signal generation circuit, a gamma correction circuit, or a DA converter circuit) can be formed over the same substrate.

Note that when a catalyst (e.g., nickel) is used in the case of forming microcrystalline silicon, crystallinity can be further improved and a transistor having excellent electric characteristics can be formed. At this time, crystallinity can be improved by just performing heat treatment without performing laser light irradiation. Accordingly, a gate driver circuit (e.g., a scan line driver circuit) and part of a source driver circuit (e.g., an analog switch) can be formed over the same substrate. In addition, in the case of not performing laser light irradiation for crystallization, crystallinity unevenness of silicon can be suppressed. Therefore, an image of which quality is improved can be displayed.

Note that polycrystalline silicon and microcrystalline silicon can be formed without using a catalyst (e.g., nickel).

Note that it is preferable that crystallinity of silicon be improved to polycrystalline, microcrystalline, or the like in the whole panel; however, the present invention is not limited to this. Crystallinity of silicon may be improved only in part of the panel. Selective increase in crystallinity can be achieved by selective laser irradiation or the like. For example, only a peripheral driver circuit region excluding pixels may be irradiated with laser light. Alternatively, only a region of a gate driver circuit, a source driver circuit, or the like may be irradiated with laser light. Further alternatively, only part of a source driver circuit (e.g., an analog switch) may be irradiated with laser light. Accordingly, crystallinity of silicon can be improved only in a region in which a circuit needs to be operated at high speed. Since a pixel region is not particularly needed to be operated at high speed, even if crystallinity is not improved, the pixel circuit can be operated without problems. Since a region, crystallinity of which is improved, is small, manufacturing steps can be decreased, throughput can be increased, and manufacturing cost can be reduced. Since the number of necessary manufacturing apparatus is small, manufacturing cost can be reduced.

Alternatively, a transistor can be formed by using a semiconductor substrate, an SOI substrate, or the like. Thus, a transistor with high current supply capability, and with a small size can be formed. When such a transistor is used, power consumption of a circuit can be reduced or a circuit can be highly integrated.

Alternatively, a transistor including a compound semiconductor or an oxide semiconductor such as ZnO, a-InGaZnO, SiGe, GaAs, IZO, ITO, or SnO, a thin film transistor obtained by thinning such a compound semiconductor or an oxide semiconductor, or the like can be used. Thus, manufacturing temperature can be lowered and for example, such a transistor can be formed at room temperature. Accordingly, the transistor can be formed directly on a substrate having low heat resistance, such as a plastic substrate or a film substrate. Note that such a compound semiconductor or an oxide semiconductor can be used for not only a channel portion of the transistor but also other applications. For example, such a compound semiconductor or an oxide semiconductor can be used as a resistor, a pixel electrode, or a light-transmitting electrode. Further, since such an element can be formed at the same time as the transistor, cost can be reduced.

Alternatively, a transistor formed by using an inkjet method or a printing method, or the like can be used. Accordingly, a transistor can be formed at room temperature, can be formed at a low vacuum, or can be formed using a large substrate. Since the transistor can be formed without using a mask (a reticle), a layout of the transistor can be easily changed. Further, since it is not necessary to use a resist, material cost is reduced and the number of steps can be reduced. Furthermore, since a film is formed only in a necessary portion, a material is not wasted compared with a manufacturing method in which etching is performed after the film is formed over the entire surface, so that cost can be reduced.

Alternatively, a transistor including an organic semiconductor or a carbon nanotube, or the like can be used. Accordingly, such a transistor can be formed using a substrate which can be bent. The semiconductor device using such a substrate can resist a shock.

Note that a transistor can be formed using various types of substrates without being limited to a certain type. As the substrate, for example, a single crystal substrate, an SOI substrate, a glass substrate, a quartz substrate, a plastic substrate, a stainless steel substrate, a substrate including a stainless steel foil, or the like can be used. Alternatively, the transistor may be formed using one substrate, and then, the transistor may be transferred to another substrate, and the transistor may be provided over another substrate. A single crystal substrate, an SOI substrate, a glass substrate, a quartz substrate, a plastic substrate, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, a stainless steel substrate, a substrate including a stainless steel foil, or the like can be used as a substrate to which the transistor is transferred. Alternatively, a skin (e.g., epidermis or corium) or hypodermal tissue of an animal such as a human being can be used as a substrate. Further alternatively, the transistor may be formed using one substrate and the substrate may be thinned by polishing. A single crystal substrate, an SOI substrate, a glass substrate, a quartz substrate, a plastic substrate, a stainless steel substrate, a substrate including a stainless steel foil, or the like can be used as a substrate to be polished. When such a substrate is used, a transistor with excellent properties or a transistor with low power consumption can be formed, a device with high durability, high heat resistance can be provided, or reduction in weight or thickness can be achieved.

Note that a structure of a transistor can be various forms without being limited to a certain structure. For example, a multi-gate structure having two or more gate electrodes may be used. When the multi-gate structure is used, a structure where a plurality of transistors are connected in series is provided because channel regions are connected in series. With the multi-gate structure, off-current can be reduced or the withstand voltage of the transistor can be increased (improvement of reliability). Alternatively, with the multi-gate structure, drain-source current does not fluctuate very much even if drain-source voltage fluctuates when the transistor operates in a saturation region, so that a flat slope of voltage-current characteristics can be obtained. When the voltage-current characteristic of which slope is flat is utilized, an ideal current source circuit or an active load having an extremely high resistance value can be realized. Accordingly, a differential circuit or a current mirror circuit having excellent properties can be realized.

As another example, a structure where gate electrodes are formed above and below a channel may be employed. When the structure where gate electrodes are formed above and below the channel is used, a channel region is increased, so that current value can be increased. Alternatively, when the structure where gate electrodes are formed above and below the channel is used, a depletion layer can be easily formed, so that subthreshold swing (S value) can be improved. Note that when the gate electrodes are formed above and below the channel, a structure where a plurality of transistors are connected in parallel is provided.

A structure where a gate electrode is formed above a channel region, a structure where a gate electrode is formed below a channel region, a staggered structure, an inverted staggered structure, a structure where a channel region is divided into a plurality of regions, or a structure where channel regions are connected in parallel or in series can be used. Further alternatively, a source electrode or a drain electrode may overlap with a channel region (or part of it). When the structure where the source electrode or the drain electrode may overlap with the channel region (or part of it) is used, the case can be prevented in which electric charges are accumulated in part of the channel region, which would result in an unstable operation. Further alternatively, a structure in which an LDD region is provided may be applied. When the LDD region is provided, off-current can be reduced or the withstand voltage of the transistor can be increased (improvement of reliability). Yet alternatively, when the LDD region is provided, drain-source current does not fluctuate very much even if drain-source voltage fluctuates when the transistor operates in the saturation region, so that a flat slope of voltage-current characteristics can be obtained.

Note that various types of transistors can be used as a transistor and the transistor can be formed using various types of substrates. Accordingly, all the circuits that are necessary to realize a predetermined function can be formed using the same substrate. For example, all the circuits that are necessary to realize the predetermined function can be formed using a glass substrate, a plastic substrate, a single crystal substrate, an SOI substrate, or any other substrate. When all the circuits that are necessary to realize the predetermined function are formed using the same substrate, cost can be reduced by reduction in the number of component parts or reliability can be improved by reduction in the number of connections to circuit components. Alternatively, part of the circuits which are necessary to realize the predetermined function can be formed using one substrate and another part of the circuits which are necessary to realize the predetermined function can be formed using another substrate. That is, not all the circuits that are necessary to realize the predetermined function are required to be formed using the same substrate. For example, part of the circuits which are necessary to realize the predetermined function may be formed by transistors using a glass substrate and another part of the circuits which are necessary to realize the predetermined function may be formed using a single crystal substrate, so that an IC chip formed by a transistor over the single crystal substrate can be connected to the glass substrate by COG (chip on glass) and the IC chip may be provided over the glass substrate. Alternatively, the IC chip can be connected to the glass substrate by TAB (tape automated bonding) or a printed wiring board. When part of the circuits are formed using the same substrate in this manner, cost can be reduced by reduction in the number of component parts or reliability can be improved by reduction in the number of connections to circuit components. Further alternatively, when circuits with high driving voltage and high driving frequency, which consume large power, are formed, for example, over a single crystal semiconductor substrate instead of forming such circuits using the same substrate and an IC chip formed by the circuit is used, increase in power consumption can be prevented.

Note that a transistor is an element having at least three terminals of a gate, a drain, and a source. The transistor has a channel region between a drain region and a source region, and current can flow through the drain region, the channel region, and the source region. Here, since the source and the drain of the transistor change depending on the structure, the operating condition, and the like of the transistor, it is difficult to define which is a source or a drain. Therefore, a region functioning as a source and a drain is not called the source or the drain in some cases. In such a case, one of the source and the drain may be referred to as a first terminal and the other thereof may be referred to as a second terminal, for example. Alternatively, one of the source and the drain may be referred to as a first electrode and the other thereof may be referred to as a second electrode. Further alternatively, one of the source and the drain may be referred to as a first region and the other thereof may be called a second region.

Note that a semiconductor device corresponds to a device having a circuit including a semiconductor element (e.g., a transistor, a diode, or a thyristor). The semiconductor device may also include all devices that can function by utilizing semiconductor characteristics. Alternatively, the semiconductor device corresponds to a device having a semiconductor material.

Note that a display device corresponds to a device having a display element. The display device may include a plurality of pixels each having a display element. Note that the display device may also include a peripheral driver circuit for driving the plurality of pixels. The peripheral driver circuit for driving the plurality of pixels may be formed over the same substrate as the plurality of pixels. The display device may also include a peripheral driver circuit provided over a substrate by wire bonding or bump bonding, namely, an IC chip connected by chip on glass (COG) or an IC chip connected by TAB or the like. Further, the display device may also include a flexible printed circuit (FPC) to which an IC chip, a resistor, a capacitor, an inductor, a transistor, or the like is attached. Note also that the display device includes a printed wiring board (PWB) which is connected through a flexible printed circuit (FPC) and to which an IC chip, a resistor, a capacitor, an inductor, a transistor, or the like is attached. The display device may also include an optical sheet such as a polarizing plate or a retardation plate. Note that the display device may also include a lighting device, a housing, an audio input and output device, a light sensor, or the like.

Note that when it is explicitly described that "B is formed on A" or "B is formed over A", it does not necessarily mean that B is formed in direct contact with A. The description includes the case where A and B are not in direct contact with each other, i.e., the case where another object is interposed between A and B. Here, each of A and B corresponds to an object (e.g., a device, an element, a circuit, a wiring, an electrode, a terminal, a conductive film, or a layer).

Accordingly, for example, when it is explicitly described that "a layer B is formed on (or over) a layer A", it includes both the case where the layer B is formed in direct contact with the layer A, and the case where another layer (e.g., a layer C or a layer D) is formed in direct contact with the layer A and the layer B is formed in direct contact with the layer C or D. Note that another layer (e.g., a layer C or a layer D) may be a single layer or a plurality of layers.

Similarly, when it is explicitly described that "B is formed above A", it does not necessarily mean that B is formed in direct contact with A, and another object may be interposed therebetween. Thus, for example, when it is described that "a layer B is formed above a layer A", it includes both the case where the layer B is formed in direct contact with the layer A, and the case where another layer (e.g., a layer C or a layer D) is formed in direct contact with the layer A and the layer B is formed in direct contact with the layer C or D. Note that another layer (e.g., a layer C or a layer D) may be a single layer or a plurality of layers.

Note that when it is explicitly described that "B is formed over A", or "B is formed above A", it includes the case where B is formed obliquely over/above A.

Note that the same can be said when it is described that B is formed below or under A.

Note that when an object is explicitly described in a singular form, the object is preferably singular. Note that the number is not limited to this, and the object can be plural. Similarly, when an object is explicitly described in a plural form, the object is preferably plural. Note that the number is not limited to this, and the object can be singular.

Note that the size, the thickness of a layer, or a region in a diagram is exaggerated in some cases for clear description. Therefore, it is not always limited to the scale. In addition, "and/or" includes any and all combinations of one or more of listed matter. The term such as "comprises" or "comprising" used in the specification specifies a characteristic, a step, an operation, an element, a member, or the like; however, the term does not exclude one or more of other characteristics, steps, operations, elements, members, or the like. The terms which means spatial arrangement such as "beneath", "below", "lower", "above", "upper", and the like are used to simply illustrate the relation between one element or one feature and other elements or other features. The terms which means spatial arrangement include not only the direction of an object which is illustrated in the drawings but also other rotated directions of the object. For example, when a device illustrated in drawing is turned upside down, other elements arranged "below" and "beneath" of the element is also turned such that the other element is above of the element. Such a typical term "below" includes the direction of "above" and "below". A device can be rotated (at 90° or other directions). A description of spatial arrangement is interpreted depending on the situation. Note that a definite article and an indefinite article can be interchangeable according to circumstances.

Note that diagrams are perspective views of ideal examples, and the shape or the value illustrated in the diagrams is not limited to that in the diagrams. For example, the following can be included: variation in the shape due to the manufacturing technique; variation in the shape by dimensional deviation; variation in a signal, voltage, or current by noise; variation in a signal, voltage, or current by a gap of timing; or the like.

Note that a technical term is used in order to describe a particular embodiment mode or embodiment or the like in many cases, and is not limited to this.

Note that terms which are not defined (including terms used for science and technology such as technical term or academic parlance) can be used as the terms which have meaning equal to general meaning that an ordinary person skilled in the art understands. It is preferable that the term defined by dictionaries or the like be construed as consistent meaning with background of related art.

Note that the terms such as first, second, third, or the like are used to distinguish various elements, members, regions, layers, and areas from others. Therefore, terms such as first, second, third, or the like are not limited to the number of the elements, members, regions, layers, areas, or the like. Further, for example, "the first" can be replaced with "the second", "the third", or the like.

The influence of variation in threshold voltage of a transistor can be reduced. Alternatively, the influence of variation in mobility of a transistor can be reduced. Alternatively, the influence of variation in current characteristics of a transistor can be reduced. Alternatively, a long input period of an image signal can be obtained. Alternatively, a long compensation period in order to reduce the influence of variation in threshold voltage can be obtained. Alternatively, a long compensation period to reduce the influence of variation in mobility can be obtained. Alternatively, a distortion of waveform of an image signal does not easily influence. Alternatively, not only the line sequential driving but also the dot sequential driving can be used. Alternatively, a pixel and a driver circuit can be formed over the same substrate. Alternatively, power consumption can be reduced. Alternatively, the cost can be reduced. Alternatively, a contact failure at a connection portion of wirings can be reduced. Alternatively, reliability can be increased. Alternatively, a large number of pixels can be increased. Alternatively, frame frequency can be increased. Alternatively, panel size can be increased.

DETAILED DESCRIPTION OF THE INVENTION

Figure 1A:
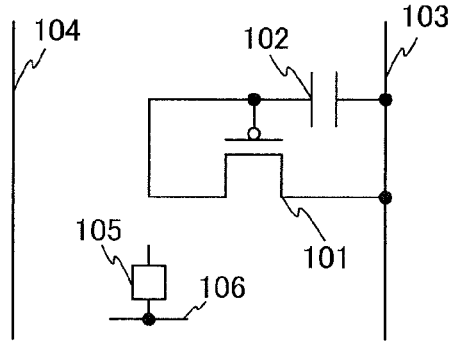
FIGS. 1A to 1H illustrate a circuit or a driving method described in an embodiment mode.

Embodiment modes of the present invention will be described below with reference to drawings. However, the present invention can be implemented in various different modes, and it is easily understood by those skilled in the art that various changes and modifications of the modes and details are possible, unless such changes and modifications depart from the content and the scope of the invention. Therefore, the present invention is not construed as being limited to description of the embodiment modes. Note that in structures of the present invention described below, reference numerals denoting the same components are used in common in different drawings, and detailed description of the same portions or portions having similar functions is omitted.

Hereinafter, embodiment modes will be described with reference to various drawings. In that case, in an embodiment mode, the contents (or may be part of the contents) described in each drawing can be freely applied to, combined with, or replaced with the contents (or may be part of the contents) described in another drawing. Similarly, the contents (or may be part of the contents) described in each drawing of an embodiment mode or a plurality of embodiment modes can be freely applied to, combined with, or replaced with the contents (or may be part of the contents) described in a drawing of another embodiment mode or a plurality of other embodiment modes.

Embodiment Mode 1

FIGS. 1A to 1H illustrate an example of a driving method, a drive timing, and a circuit configuration at the time in the case where variation in current characteristics such as mobility of a transistor is compensated.

FIG. 1A illustrates a circuit configuration in a period in which variation in current characteristics such as mobility of a transistor 101 is compensated. Note that the circuit configuration illustrated in FIG. 1A is the circuit configuration for discharging charge held in a gate of the transistor in order to compensate variation in current characteristics such as mobility of the transistor 101, and actually the relation of connection of the circuit configuration is realized by controlling on or off of a plurality of switches provided between wirings.

In FIG. 1A, a connection between a source (a drain, a first terminal, or a first electrode) of the transistor 101 and a wiring 103 is conducting. A connection between a drain (a source, a second terminal, or a second electrode) of the transistor 101 and a gate of the transistor 101 is conducting. A connection between a first terminal (or a first electrode) of a capacitor element 102 and the gate of the transistor 101 is conducting. A connection between a second terminal (or a second electrode) of the capacitor element 102 and the wiring 103 is conducting.

A connection between a first terminal (or a first electrode) of a display element 105 and the drain (the source, the second terminal, or the second electrode) of the transistor 101 is nonconducting. A connection between a terminal, a wiring, or an electrode other than the drain (the source, the second terminal, or the second electrode) of the transistor 101, and the first terminal (or the first electrode) of the display element 105 is preferably nonconducting; however, the conduction state is not limited to this. A connection between a second terminal (or a second electrode) of the display element 105 and a wiring 106 is preferably conducting; however, the conduction state is not limited to this.

A connection between a wiring 104 and the drain (the source, the second terminal, or the second electrode) of the transistor 101 is nonconducting. Further, a connection between the wiring 104 and the first terminal (or the first electrode) of the capacitor element 102 is nonconducting. Note that as illustrated in FIG. 1A, a connection between the wiring 104 and any terminals, wirings, and electrodes other than the drain (the source, the second terminal, or the second electrode) of the transistor 101 and the first terminal (or the first electrode) of the capacitor element 102 is preferably nonconducting; however, the conduction state is not limited to this.

Note that an image signal, predetermined voltage, or the like is supplied to the transistor 101 or the capacitor element 102 through wiring 104 in some cases. Therefore, the wiring 104 is referred to as a source signal line, an image signal line, a video signal line, or the like.

Note that before a connection structure like FIG. 1A is realized, that is, before variation in current characteristics such as mobility of the transistor 101 is compensated, it is preferable that voltage corresponding to the threshold voltage of the transistor 101 be held in the capacitor element 102. Further, it is preferable that an image signal (a video signal)

be input to the capacitor element 102 through the wiring 104. Thus, it is preferable that total voltage of voltage corresponding to the threshold voltage of the transistor 101 and image signal voltage be held in the capacitor element 102. Therefore, in a state before FIG. 1A is realized, that is, before variation in current characteristics such as mobility of the transistor 101 is compensated, a connection between the wiring 104, and at least one of the drain, the source, and the gate of the transistor 101, the first terminal (or the first electrode) or the second terminal (or the second electrode) of the capacitor element 102, and the like is conducting, and it is preferable that an image signal have already input.

Note that it is preferable that total voltage of voltage corresponding to the threshold voltage of the transistor 101 and image signal voltage be held in the capacitor element 102; however, the state is not limited to this. It is possible that the capacitor element 102 holds only image signal voltage without holding voltage corresponding to the threshold voltage of the transistor 101.

Note that when voltage is held in the capacitor element 102, there is a possibility that the voltage fluctuates slightly by switching noise or the like. However, the minor fluctuation does not matter as long as the fluctuation is within the range that does not influence on the real operation. Thus, for example, in the case where total voltage of voltage corresponding to the threshold voltage of the transistor 101 and image signal voltage is input to the capacitor element 102, the actual voltage held in the capacitor element 102 is not completely the same as the input voltage, and the level of the voltage slightly differs due to influence of noise or the like in some cases. However, a minor fluctuation does not matter as long as the fluctuation is within the range that does not influence on the real operation.

Figure 1B:
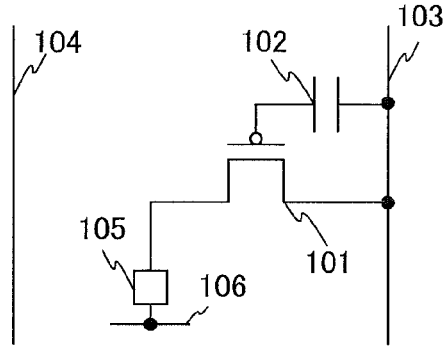

Next, FIG. 1B illustrates a circuit configuration in a period in which current is supplied to the display element 105 through the transistor 101. Note that the circuit configuration illustrated in FIG. 1B is the circuit configuration for supplying current to the display element 105 from the transistor 101, and actually the relation of connection of the circuit configuration is realized by controlling on or off of a plurality of switches provided between wirings.

A connection between the source (the drain, the first terminal, or the first electrode) of the transistor 101 and the wiring 103 is conducting. A connection between the drain (the source, the second terminal, or the second electrode) of the transistor 101 and the first terminal (or the first electrode) of the display element 105 is conducting. A connection between the drain (the source, the second terminal, or the second electrode) of the transistor 101 and the gate of the transistor 101 is nonconducting. A connection between the first terminal (or the first electrode) of the capacitor element 102 and the gate of the transistor 101 is conducting. A connection between the second terminal (or the second electrode) of the capacitor element 102 and the wiring 103 is conducting. A connection between the second terminal (or the second electrode) of the display element 105 and the wiring 106 is conducting.

A connection between the wiring 104 and the drain (the source, the second terminal, or the second electrode) of the transistor 101 is nonconducting. Further, a connection between the wiring 104 and the first terminal (or the first electrode) of the capacitor element 102 is nonconducting. Note that as illustrated in FIG. 1B, a connection between the wiring 104 and any terminals, wirings, and electrodes other than the drain (the source, the second terminal, or the second electrode) of the transistor 101 and the first terminal (or the first electrode) of the capacitor element 102 is preferably nonconducting; however, the conduction state is not limited to this.

In other words, when a period in which variation in current characteristics such as mobility of the transistor 101 is compensated (FIG. 1A) shifts to a period in which current is supplied to the display element 105 through the transistor 101 (FIG. 1B), at least a conducting state between the drain (the source, the second terminal, or the second electrode) of the transistor 101 and the gate of the transistor 101 and a conducting state between the drain (the source, the second terminal, or the second electrode) of the transistor 101 and the first terminal (or the first electrode) of the display element 105 are changed. The change is not limited to this and a conducting state of other portions can be changed. Then, it is preferable that an element such as a switch, a transistor, or a diode be provided so as to be able to control the conducting state as described above. Therefore, the conducting state is controlled by using the element, and a circuit configuration which realizes a connection state illustrated in FIGS. 1A and 1B can be realized. Therefore, if the connection states illustrated in FIGS. 1A and 1B can be realized, an element such as a switch, a transistor, or a diode can be provided freely without being limited to the number and the connection structure.

Figure 2A:
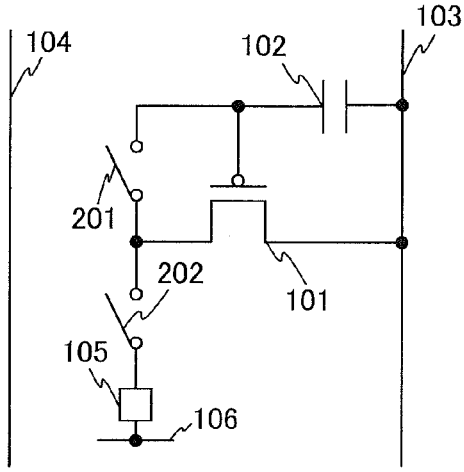
FIGS. 2A to 2F illustrate a circuit or a driving method described in an embodiment mode.

As one example, as illustrated in FIG. 2A, a first terminal of a switch 201 is electrically connected to the gate of the transistor 101, and a second terminal is electrically connected to the drain (the source, the second terminal, or the second electrode) of the transistor 101. Then, a first terminal of a switch 202 is electrically connected to the drain (the source, the second terminal, or the second electrode) of the transistor 101, and a second terminal is electrically connected to the display element 105. As thus described, providing two switches allows realization of the circuit configuration which realizes the connection states of FIGS. 1A and 1B.

Figure 2B:
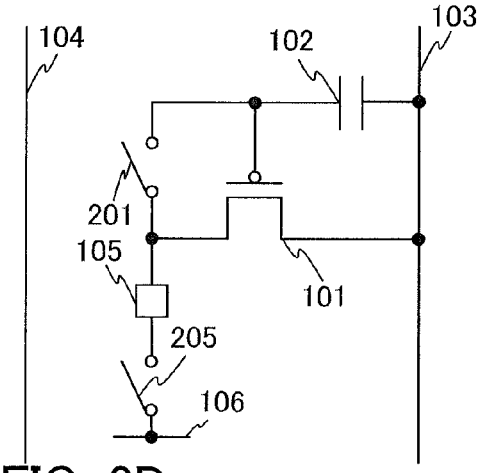
Figure 2C:
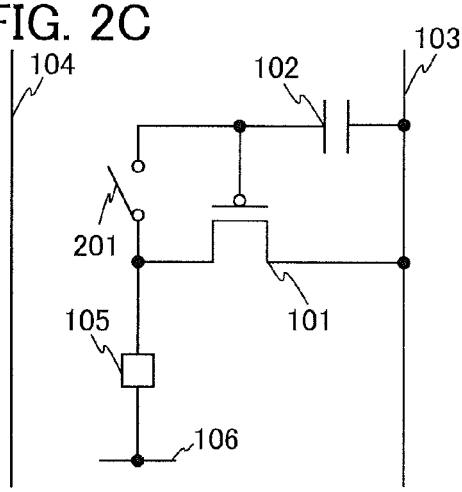

FIGS. 2B and 2C illustrate an example which is different from that in FIG. 2A. In FIG. 2B, a position of the switch 202 in FIG. 2A is changed to a position like a switch 205 in FIG. 2B. In FIG. 2C, the switch 202 in FIG. 2A is deleted. Instead of that, for example, the display element 105 is brought out of conduction by change of the potential of the wiring 106, and the operation which is similar to that of FIG. 1A can be realized. Then, when a switch, a transistor, or the like is further needed, it is provided as appropriate.

Note that when description of "a connection between A and B is conducting" can include the case where various elements are connected between A and B. For example, a resistor element, a capacitor element, a transistor, a diode, and the like can be connected in series or in parallel between A and B. Similarly, when description of "a connection between A and B is nonconducting" can include the case where various elements are connected between A and B. It is acceptable as long as a connection between A and B is nonconducting, so that various elements can be connected in other portions. For example, elements such as a resistor element, a capacitor element, a transistor, a diode, and the like can be connected in series or in parallel.

Figure 2D:
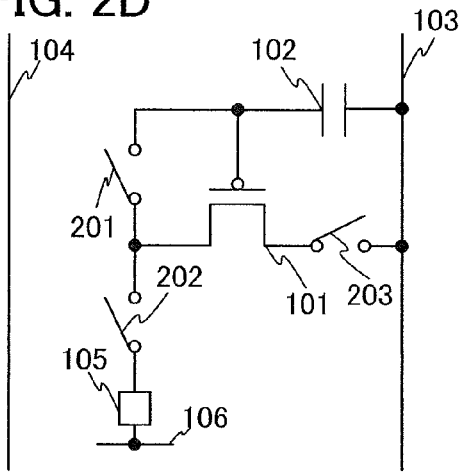
Figure 2E:
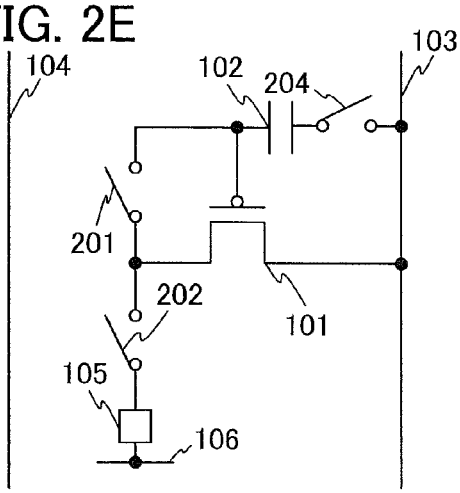
Figure 2F:
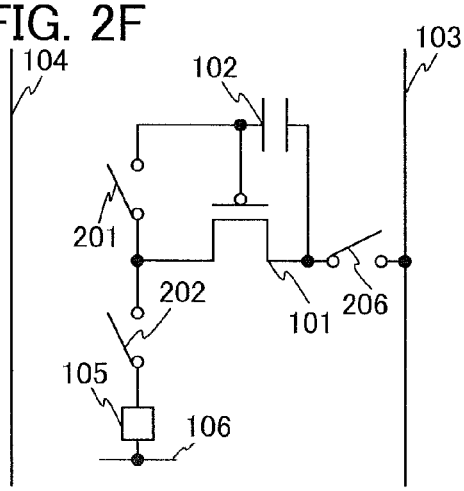

Thus, for example, FIG. 2D illustrates a circuit in the case where a switch 203 is added to a circuit of FIG. 2A. FIG. 2E illustrates a circuit in the case where a switch 204 is added to the circuit of FIG. 2A. FIG. 2F illustrates the circuit in the case where a switch 206 is added to the circuit of FIG. 2A.

As thus described, in the period in which variation in current characteristics such as mobility of the transistor 101 is compensated (FIG. 1A), variation in current characteristics such as mobility of the transistor 101 is reduced, so that variation in current supplied to the display element 105 is also reduced in the period in which current is supplied to the display element 105 (FIG. 1B). As a result, variation in a display state of the display element 105 can also be reduced, whereby a high-definition display can be obtained.

The above-described circuit configurations illustrated in FIGS. 2A to 2F are used as an example to realize the circuit configurations illustrated in FIGS. 1A and 1B. Note that actually the relation of connection of the circuit configuration is realized by controlling on or off of a plurality of switches provided between wirings in addition to a plurality of switches illustrated in FIGS. 2A to 2F.

Note that the period in which current is supplied to the display element 105 (FIG. 1B) is preferably made to appear immediately after the period in which variation in current characteristics such as mobility of the transistor 101 is compensated (FIG. 1A). This is because the gate potential (charge held in the capacitor element 102) of the transistor 101 gained in the period in which current is supplied to the display element 105 (FIG. 1B) is used to perform a process in the period in which current is supplied to the display element 105 (FIG. 1B). However, the operation is not limited to the operation that the period in which current is supplied to the display element 105 (FIG. 1B) is appeared immediately after the period in which variation in current characteristics such as mobility of the transistor 101 is compensated (FIG. 1A). In the period in which variation in current characteristics such as mobility of the transistor 101 is compensated, in the case where the amount of charge in the capacitor element 102 is changed, and where the amount of charge in the capacitor element 102 which is determined at the termination of the period is not largely changed in the period in which current is supplied to the display element 105 (FIG. 1B), a period for another process may be provided between the period in which variation in current characteristics such as mobility of the transistor 101 is compensated (FIG. 1A) and the period in which current is supplied to the display element 105 (FIG. 1B).

Thus, it is preferable that the amount of charge held in the capacitor element 102 at the termination of the period in which variation in current characteristics such as mobility of the transistor 101 is compensated be substantially the same as the amount of charge held in the capacitor element 102 at the beginning of the period in which current is supplied to the display element 105. Note that the amounts of charge in both periods are slightly different from each other due to the influence of noise or the like in some cases. Specifically, the difference of the amounts of charge in both periods is preferably 10% or less, more preferably 3% or less. It is more preferable that the difference of the amounts of charge is 3% or less, because human eyes cannot see the difference when watch a display element which reflects the difference.

Figure 3A:
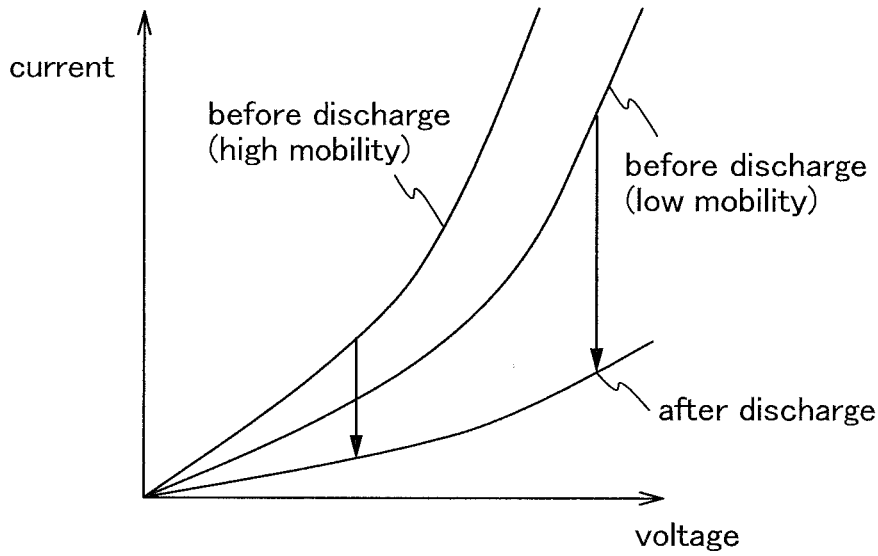
FIGS. 3A and 3B illustrate an operation described in an embodiment mode.

Then, FIG. 3A illustrates to what state current-voltage characteristics changes in the period in which variation in current characteristics such as mobility of the transistor 101 is compensated (FIG. 1A). Charge held in the capacitor element 102 is discharged through the source and the drain of the transistor 101 in the period in which variation in current characteristics such as mobility of the transistor 101 is compensated (FIG. 1A). As a result, the amount of charge held in the capacitor element 102 decreases, and the voltage held in the capacitor element 102 also decreases. Therefore, the absolute value of voltage between the gate and the source of the transistor 101 also decreases. Charge held in the capacitor element 102 is discharged through the transistor 101, so that the amount of the charge to be discharged depends on the current characteristics of the transistor 101. In other words, if mobility of the transistor 101 is high, larger amount of charge is discharged. Alternatively, if the ratio (W/L) of channel width W to channel length L of the transistor 101 is large, larger amount of charge is discharged. Alternatively, if the absolute value of the voltage between the gate and the source of the transistor 101 (that is, the large absolute value of the voltage held in the capacitor element 102) is large, larger amount of charge is discharged. Alternatively, if parasitic resistance in the source region and the drain region of the transistor 101 is small, larger amount of charge is discharged. Alternatively, if resistance in an LDD region of the transistor 101 is small, larger amount of charge is discharged. Further alternatively, if contact resistance in a contact hole which is electrically connected to the transistor 101 is small, larger amount of charge is discharged.

Therefore, a curve of a graph of current-voltage characteristics before discharge, that is, before to be the period in which variation in current characteristics such as mobility of the transistor 101 is compensated (FIG. 1A) changes into a curve with a gentle slope as a result of discharge of part of the charge held in the capacitor element 102 in the period in which variation in current characteristics such as mobility of the transistor 101 is compensated (FIG. 1A). Then, for example, the difference of the graph of current-voltage characteristics before and after the discharge becomes large as mobility of the transistor 101 is higher. Thus, when mobility of the transistor 101 is high (that is, when the slope of the graph is large), amount of change in the slope becomes large after discharge. When mobility of the transistor 101 is low (that is, when slope of the graph is small), amount of change in the slope becomes small after discharge. As a result, after discharge, in the cases of high mobility and low mobility of the transistor 101, the difference of the graph of current-voltage characteristic becomes small, whereby influence of variation in mobility can be reduced. Moreover, if the absolute value of the voltage between the gate and the source of the transistor 101 is large (that is, the absolute value of the voltage held in the capacitor element 102 is large), larger amount of charge is discharged. On the other hand, if the absolute value of the voltage between the gate and the source of the transistor 101 is small (that is, the absolute value of the voltage held in the capacitor element 102 is small), smaller amount of charge is discharged. Thus, variation in mobility can be reduced as appropriate.

Figure 3B:
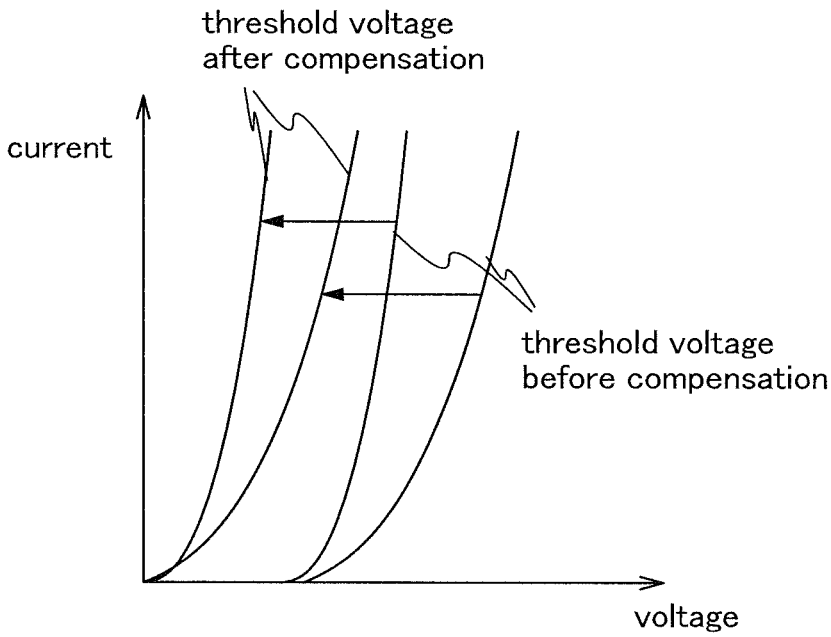

Note that the graph in FIG. 3A illustrates the case where influence of variation in the threshold voltage has already reduced. Therefore, as illustrated in FIG. 3B, influence of variation in the threshold voltage has reduced before to be the period in which variation in mobility of the transistor 101 is compensated (FIG. 1A). In order to reduce variation in the threshold voltage, the graph of current-voltage characteristics is shifted in parallel by the threshold voltage. In other words, total voltage of image signal voltage and the threshold voltage are supplied to the voltage between the gate and the source of the transistor. As a result, influence of variation in the threshold voltage can be reduced. After variation in threshold voltage is reduced, as illustrated in the graph of FIG. 3A, variation in current characteristic of the transistor 101 can be largely reduced by reducing variation in mobility.

Note that current characteristics of the transistor 101 of which variation can be compensated include not only mobility of the transistor 101, but also threshold voltage, parasitic resistance in the source portion (the drain portion), resistance in an LDD region, and contact resistance in a contact hole electrically connected to the transistor 101. Variation in these current characteristics can also be reduced as well as the case of mobility, because charge is discharged through the transistor 101.

Thus, the amount of charge of the capacitor element 102 before discharge, that is, before to be the period in which variation in current characteristics such as mobility of the transistor 101 is compensated (FIG. 1A) is larger than that at the termination of the period in which variation in current characteristics such as mobility of the transistor 101 is compensated (FIG. 1A). This is because, in the period in which variation in current characteristics such as mobility of the transistor 101 is compensated (FIG. 1A), charge in the capacitor element 102 is discharged, so that the amount of charge held in the capacitor element 102 becomes small.

Note that it is preferable that discharge be stopped soon after part of charge held in the capacitor element 102 is discharged. If charge is completely discharged, that is, charge is completely discharged until current stops flowing, information of an image signal is almost lost. Thus, it is preferable that discharge be stopped before charge is completely discharged. In other words, it is preferable that discharge be stopped while current flows in the transistor 101.

Thus, when one gate selection period (one horizontal period, or the value that one frame period divided by the number of rows of pixels) and the period in which variation in current characteristics such as mobility of the transistor 101 is compensated (FIG. 1A) are compared, it is preferable that one gate selection period (one horizontal period, or the value that one frame period divided by the number of rows of pixels) be longer than the period in which variation in current characteristics such as mobility of the transistor 101 is compensated (FIG. 1A). This is because charge is discharged longer than the one gate selection period, whereby there is a possibility that charge is discharged too much. However, the length of the period is not limited to this.

Alternatively, when a period in which an image signal is input to a pixel and the period in which variation in current characteristics such as mobility of the transistor 101 is compensated (FIG. 1A) are compared, it is preferable that the period in which an image signal is input to a pixel be longer than the period in which variation in current characteristics such as mobility of the transistor 101 is compensated (FIG. 1A). This is because charge is discharged longer than the period in which an image signal is input to a pixel, whereby there is a possibility that charge is discharged too much. However, the length of the period is not limited to this.

Alternatively, a period in which the threshold voltage of the transistor is obtained and the period in which variation in current characteristics such as mobility of the transistor 101 is compensated (FIG. 1A) are compared, it is preferable that the period in which the threshold voltage of the transistor is obtained be longer than the period in which variation in current characteristics such as mobility of the transistor 101 is compensated (FIG. 1A). This is because charge is discharged longer than the period in which the threshold voltage of the transistor is obtained, whereby there is a possibility that charge is discharged too much. However, the length of the period is not limited to this.

Note that in the period in which variation in current characteristics such as mobility of the transistor 101 is compensated (FIG. 1A), it is preferable that the length of the period in which charge held in the capacitor element 102 is discharged be determined according to the amount of variation in mobility of the transistor 101, capacitance of the capacitor element 102, W/L of the transistor 101, or the like, for example.

For example, the case where there are a plurality of circuits which are illustrated in FIGS. 1A to 1H and FIGS. 2A to 2F is considered. As an example, the circuit includes a first pixel for displaying a first color and a second pixel for displaying a second color, and the first pixel and the second pixel include a transistor 101A and a transistor 101B, respectively, as the transistors corresponding to the transistor 101. Similarly, as a capacitor element corresponding to the capacitor element 102, the first pixel and the second pixel include a capacitor element 102A and a capacitor element 102B, respectively.

Then, when W/L of the transistor 101A is larger than W/L of the transistor 101B, it is preferable that capacitance of the capacitor element 102A be larger than that of the capacitor element 102B. This is because the amount of charge discharged from the transistor 101A is larger than that from the transistor 101B, so that the voltage of the capacitor element 102A is also largely changed. Thus, it is preferable that capacitance of the capacitor element 102A be large in order to adjust the amount of voltage change. Alternatively, when the channel width W of the transistor 101A is larger than the channel width W of the transistor 101B, it is preferable that capacitance of the capacitor element 102A be larger than capacitance of the capacitor element 102B. Alternatively, when the channel length L of the transistor 101A is smaller than the channel length L of the transistor 101B, it is preferable that capacitance of the capacitor element 102A be larger than capacitance of the capacitor element 102B.

Figure 4A:
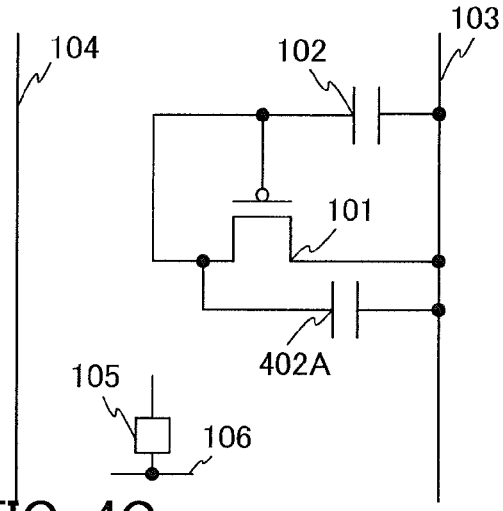
FIGS. 4A to 4F illustrate a circuit or a driving method described in an embodiment mode.
Figure 4B:
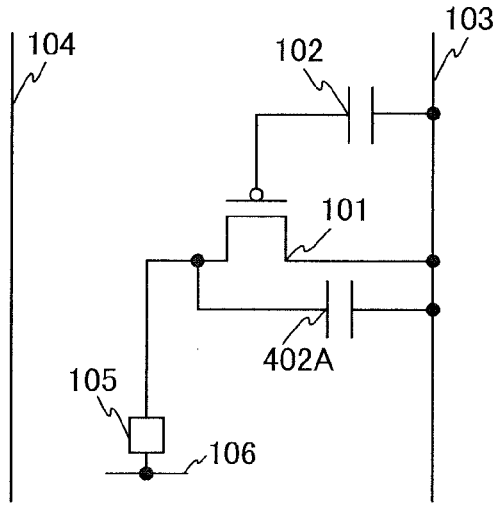

Note that it is possible to add a capacitor element in order to control the amount of charge held in the capacitor element 102 to be discharged. For example, FIGS. 4A and 4B illustrate examples in the case where a capacitor element is added to each circuit of FIGS. 1A and 1B. Note that circuit configurations illustrated in FIGS. 4A to 4F are used as examples which realize the circuit configurations illustrated in FIGS. 1A and 1B. Note that actually the relation of connection of the circuit configuration is realized by controlling on or off of a plurality of switches between wirings in addition to a plurality of switches and capacitor elements provided illustrated in FIGS. 4A to 4F.

In FIGS. 4A and 4B, a connection between a first terminal (or a first electrode) of a capacitor element 402A and the drain (the source, the second terminal, or the second electrode) of the transistor 101 is conducting, and a connection between a second terminal (or a second electrode) of the capacitor element 402A and the wiring 103 is conducting. Note that, in FIG. 4B, it is preferable that a conducting state of each terminal of the capacitor element 402A be similar to that in FIG. 4A; however, the state is not limited to this. One terminal of the capacitor element 402A may be nonconducting.

Figure 4C:
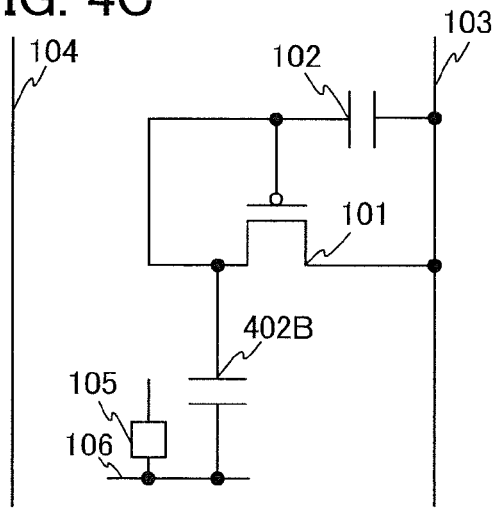
Figure 4D:
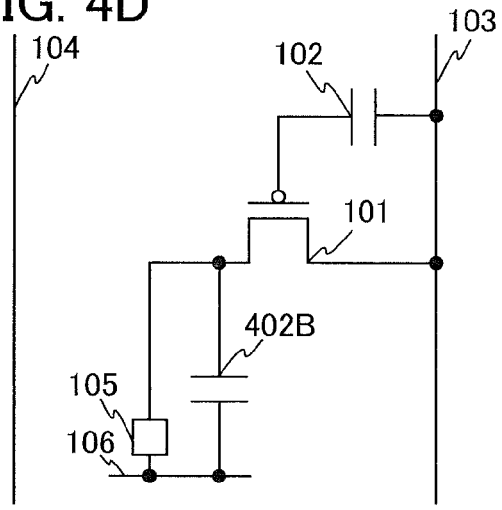

Similarly, FIGS. 4C and 4D illustrate examples when a capacitor element is added to each circuit of FIGS. 1A and 1B. A connection between a first terminal (or a first electrode) of a capacitor element 402B and the drain (the source, the second terminal, or the second electrode) of the transistor 101 is conducting, and a connection between a second terminal (or a second electrode) of the capacitor element 402B and the wiring 106 is conducting. Note that, in FIG. 4D, it is preferable that a conducting state of each terminal of the capacitor element 402B be similar to that in FIG. 4C; however, the state is not limited to this. One terminal of the capacitor element 402B may be nonconducting.

For example, the case where there are a plurality of circuits which are illustrated in FIGS. 4A to 4F or the like is considered. As an example, the circuit includes the first pixel for displaying the first color and the second pixel for displaying the second color, and the first pixel and the second pixel include the transistor 101A and the transistor 101B, respectively, as the transistors corresponding to the transistor 101. Similarly, as a capacitor element corresponding to the capacitor element 102, the first pixel and the second pixel include the capacitor element 102A and the capacitor element 102B, respectively. Furthermore, as a capacitor element corresponding to at least any one of the capacitor elements 402A to 402C, the first pixel and the second pixel include a capacitor element 402AA and a capacitor element 402AB, respectively.

Then, when W/L of the transistor 101A is larger than W/L of the transistor 101B, it is preferable that capacitance of the capacitor element 102A be larger than that of the capacitor element 102B. Alternatively, it is preferable that capacitance of the capacitor element 402AA be larger than that of the capacitor element 402AB. Alternatively, it is preferable that total capacitance of the capacitor element 102A and the capacitor element 402AA be larger than that of the capacitor element 102B and the capacitor element 402AB. This is because the amount of charge discharged from the transistor 101A is larger than that from the transistor 101B, so that potential is adjusted. Alternatively, when the channel width W of the transistor 101A is larger than the channel width W of the transistor 101B, it is preferable that capacitance of the capacitor element 102A be larger than capacitance of the capacitor element 102B. Alternatively, it is preferable that capacitance of the capacitor element 402AA be larger than that of the capacitor element 402AB. Alternatively, it is preferable that total capacitance of the capacitor element 102A and the capacitor element 402AA be larger than that of the capacitor element 102B and the capacitor element 402AB. Alternatively, when the channel length L of the transistor 101A is smaller than the channel length L of the transistor 101B, it is preferable that capacitance of the capacitor element 102A be larger than capacitance of the capacitor element 102B. Alternatively, it is preferable that capacitance of the capacitor element 402AA be larger than that of the capacitor element 402AB. Alternatively, it is preferable that total capacitance of the capacitor element 102A and the capacitor element 402AA be larger than that of the capacitor element 102B and the capacitor element 402AB.

Note that the following state is possible; capacitance of the capacitor element 402AA is different from that of the capacitor element 402AB, and capacitance of the capacitor element 102A is substantially equal to that of the capacitor element 102B. In other words, capacitance can be adjusted using not the capacitor element 102A and the capacitor element 102B, but the capacitor element 402AA and the capacitor element 402AB. When capacitance of the capacitor element 102B is different from that of the capacitor element 102A, levels of image signals are possible to differ, which influences on other operations greatly in some cases. Therefore, it is preferable that capacitance can be adjusted using the capacitor element 402AA and the capacitor element 402AB.

Figure 1C:
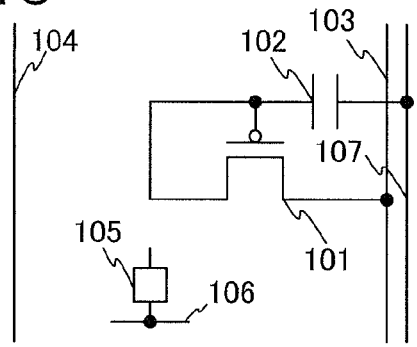
Figure 1D:
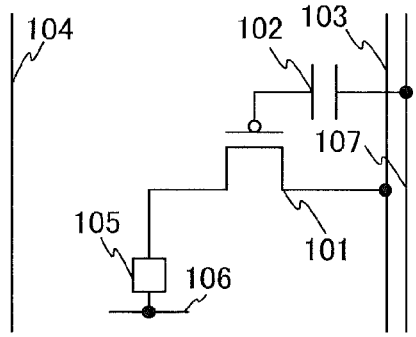
Figure 1E:
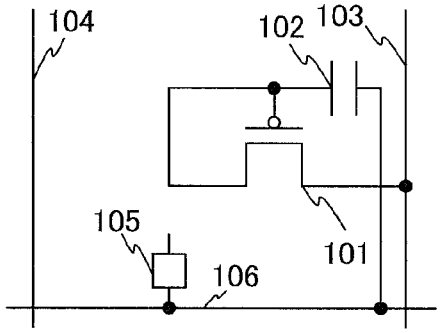
Figure 1F:
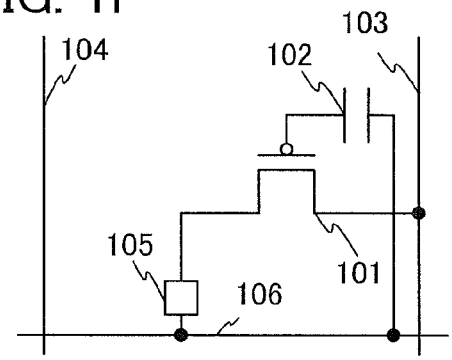

Note that a connection structure of the circuit is not limited to FIGS. 1A and 1B. For example, in FIGS. 1A and 1B, a connection between the second terminal (or the second electrode) of the capacitor element 102 and the wiring 103 is conducting; however, the conducting state is not limited to this. At least in a predetermined period, a connection between the second terminal (or the second electrode) of the capacitor element 102 and a wiring having a function for supplying a constant level of potential may be conducting. For example, FIGS. 1C and 1D illustrate examples in the case where the second terminal (or the second electrode) of the capacitor element 102 is connected to the wiring 107. Similarly, FIGS. 1E and 1F illustrate examples in the case where the second terminal (or the second electrode) of the capacitor element 102 is connected to the wiring 106.

Figure 4E:
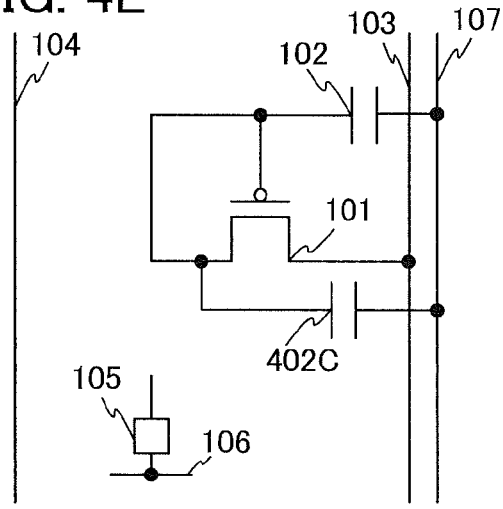
Figure 4F:
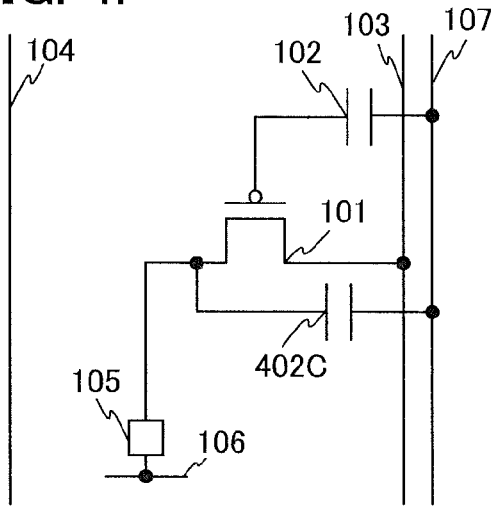
Figure 5A:
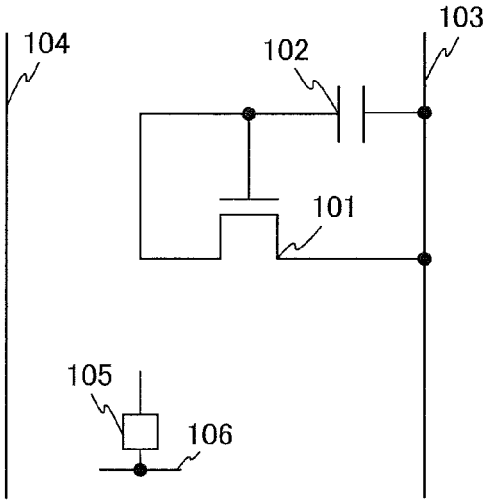
FIGS. 5A to 5D illustrate a circuit or a driving method described in an embodiment mode.
Figure 5B:
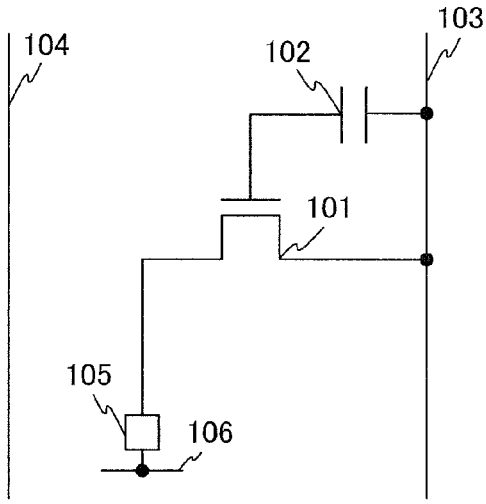
Figure 5C:
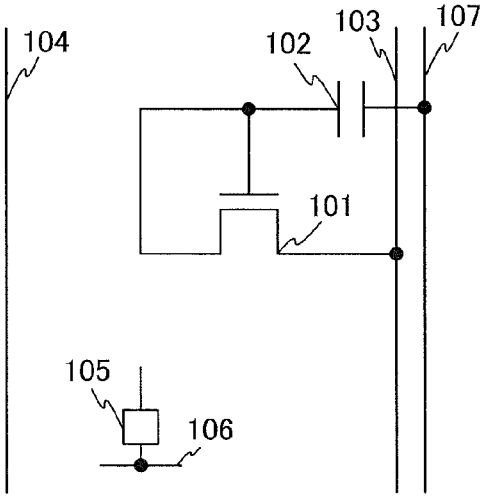
Figure 5D:
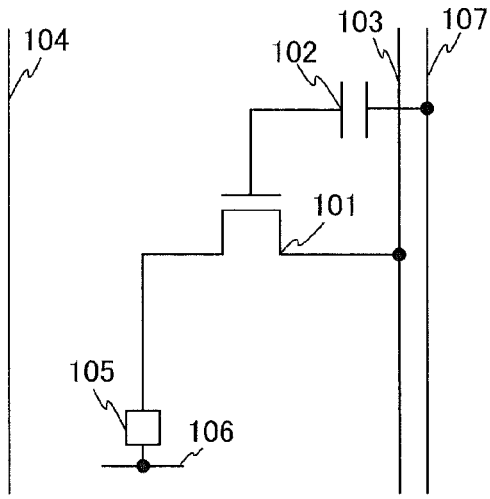

Note that, a capacitor element can be additionally provided to the circuits in FIGS. 1C to 1F in the manner similar to those in FIGS. 4A to 4D. As an example, FIGS. 4E and 4F illustrate the case where the capacitor element 402C is additionally provided to the circuits in FIGS. 1C and 1D.

Note that in the circuits in FIGS. 1C to 1F, a switch can be provided in the manner similar to FIGS. 2A to 2F.

Figure 1G:
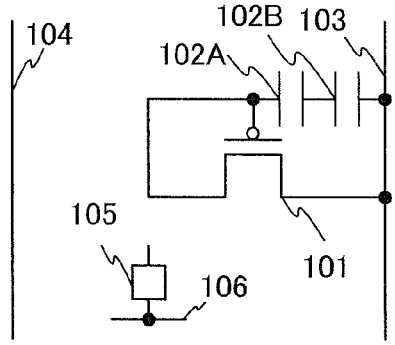
Figure 1H:
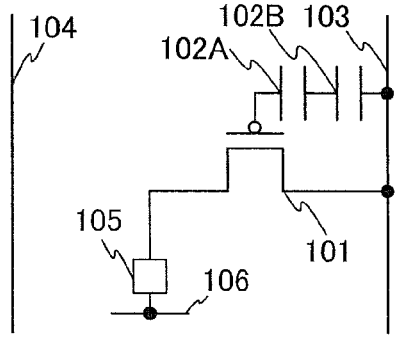

Note that, in FIGS. 1A to 1F, FIGS. 2A to 2F, FIGS. 4A to 4F, and the like, single capacitor element 102 is used for description; however, the number of capacitor elements is not limited to this. A plurality of capacitor elements can be provided in series or in parallel. For example, FIGS. 1G and 1H illustrate examples in the case where two capacitor elements 102A and 102B are connected in series in the circuits in FIGS. 1A and 1B.

Note that the case where the transistor 101 is a p-channel transistor in FIGS. 1A to 1F, FIGS. 3A and 3B, FIGS. 4A to 4F, and the like is described; however, the transistor is not limited to this. As illustrated in FIGS. 5A to 5D, an n-channel transistor can be used. As an example, FIGS. 5A to 5D illustrate the case where an n-channel transistor is used to the circuits in FIGS. 1A to 1D. That can be applied to other cases in a similar manner. Note that circuit configurations illustrated in FIGS. 5A to 5D are used as examples which realize the circuit configurations illustrated in FIGS. 1A and 1B. Note that actually the relation of connection of the circuit configuration is realized by controlling on or off of a plurality of switches provided between wirings in addition to a plurality of switches and capacitor elements illustrated in FIGS. 5A to 5D.

Note that the transistor 101 controls the amount of current flowing in the display element 105 and has a capability to drive the display element 105 in many cases; however, the function is not limited to this.

Note that the wiring 103 has a capability to supply electric power to the display element 105 in many cases. Alternatively, the wiring 103 has a capability to supply current which flows in the transistor 101 in many cases; however, the function is not limited to this.

Note that the wiring 107 has a capability to supply voltage to the capacitor element 102 in many cases. Alternatively, the wiring 107 has a capability by which gate potential of the transistor 101 is not easily changed by noise or the like in many cases; however, the function is not limited to this.

Note that the voltage corresponding to the threshold voltage of the transistor 101 is referred to the voltage having the same level as the threshold voltage of transistor 101, or voltage having a voltage level close to the threshold voltage of transistor 101. For example, when the threshold voltage of the transistor 101 is high, the voltage corresponding to the threshold voltage is also high, and when the threshold voltage of the transistor 101 is low, the voltage corresponding to the threshold voltage is also low. As thus described, the voltage of which level is determined in accordance with the threshold voltage is referred to as the voltage corresponding to the threshold voltage. Thus, the voltage of which level is slightly different from the threshold voltage due to influence of noise can also be referred to as the voltage corresponding to the threshold voltage.

Note that the display element 105 is an element having functions in which luminance, brightness, reflectivity, transmissivity, or the like is changed. Thus, as an example of the display element 105, a liquid crystal element, a light-emitting element, an organic EL element, an electrophoretic element, or the like can be used.

Note that the contents described with each drawing in this embodiment mode can be freely combined with or replaced with the contents described in another embodiment mode as appropriate.

Embodiment Mode 2

This embodiment mode will describe a specific example of the circuit and a driving method described in Embodiment Mode 1.

Figure 6A:
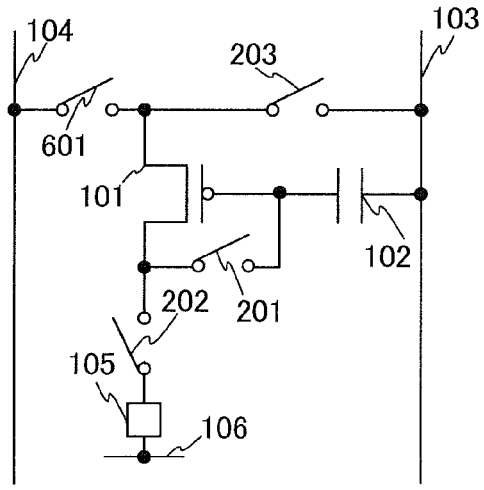
FIGS. 6A to 6F illustrate a circuit or a driving method described in an embodiment mode.

FIG. 6A illustrates a specific example of FIGS. 1A and 1B, and FIGS. 2A and 2D. A first terminal of a switch 601 is connected to the wiring 104, and a second terminal is connected to the source (or the drain) of the transistor 101. A first terminal of the switch 203 is connected to the wiring 103, and a second terminal is connected to the source (or the drain) of the transistor 101. The first terminal of the capacitor element 102 is connected to the gate of the transistor 101, and the second terminal is connected to the wiring 103. The first terminal of the switch 201 is connected to the gate of the transistor 101, the second terminal is connected to the drain (or the source) of the transistor 101. The first terminal of the switch 202 is connected to the drain (or the source) of the transistor 101, and the second terminal is connected to the first terminal of the display element 105. The second terminal of the display element 105 is connected to the wiring 106.

Figure 6B:
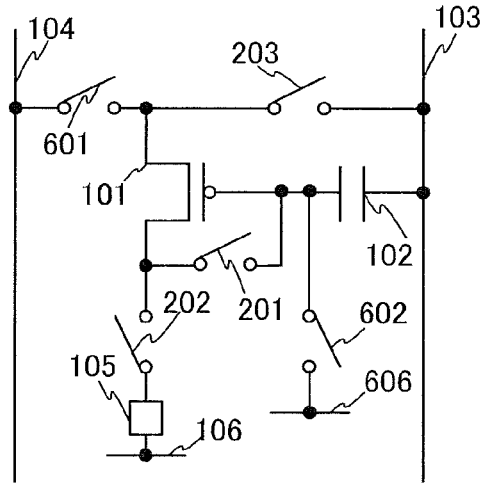
Figure 6C:
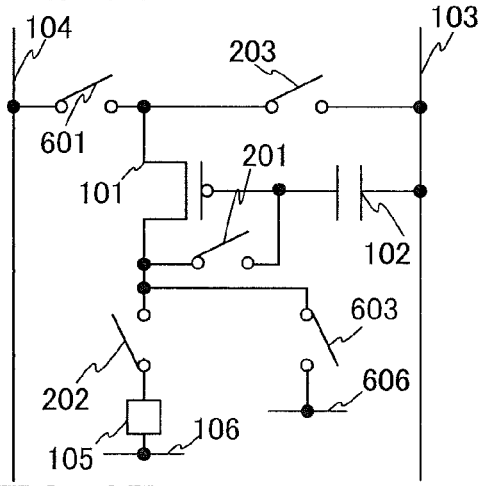

Note that a switch is preferably added in order to control the potential of the drain (or the source) or the gate of the transistor 101. However, the structure is not limited to this. FIGS. 6B and 6C illustrate examples in which a switch is added. In FIG. 6B, a switch 602 is added. A first terminal of the switch 602 is connected to the gate of the transistor 101, and a second terminal is connected to a wiring 606. In FIG. 6C, a switch 603 is added. A first terminal of the switch 603 is connected to the drain (or the source) of the transistor 101, and a second terminal is connected to the wiring 606.

Figure 6D:
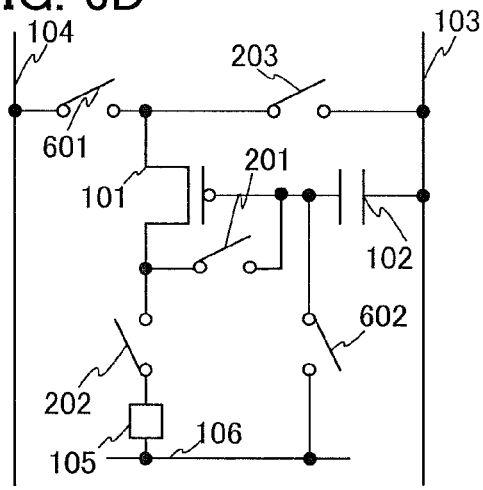

Note that one wiring is used to serve as the wiring 606 and another wiring, so that the number of the wirings can be reduced. For example, FIG. 6D illustrates an example in which the wiring 106 serves as the wiring 106 and the wiring 606, so that only the wiring 106 is used. The first terminal of the switch 602 is connected to the gate of the transistor 101, and the second terminal is connected to the wiring 106. As thus described, the second terminal of switch 602 can be connected to various wirings without limitation. Then, one wiring is also used as another wiring, so that the number of the wirings can be reduced.

Note that the connection structure of the circuit is not limited to this. As long as elements are provided so as to be able to desirably operate, various circuit configurations can be realized by providing a switch, a transistor, or the like in various places.

As thus described an example of the structure described in Embodiment Mode 1 can take various structures. Further, a specific example of FIGS. 1A and 1B, and FIGS. 2A and 2D are described; similarly, specific examples of FIGS. 1A to 1H, FIGS. 2A to 2F, FIGS. 4A to 4F, and FIGS. 5A to 5D can be realized.

Figure 6E:
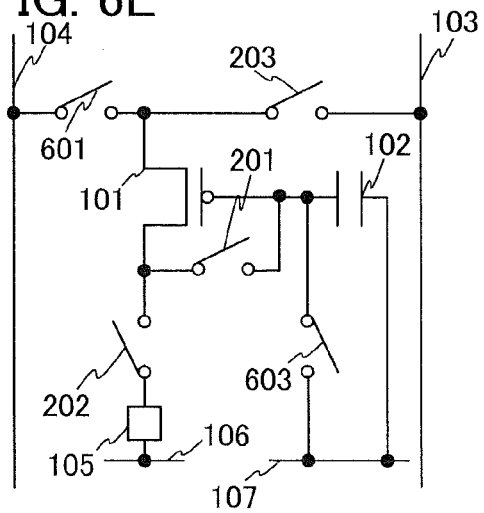

As an example, FIG. 6E illustrates an example of FIGS. 1C and 1D. Note that, in FIG. 6E, both of the second terminal of the switch 603 and the second terminal (or the second electrode) of the capacitor element 102 are connected to the wiring 107, that is, they use one wiring. However, the structure is not limited to this.

Figure 6F:
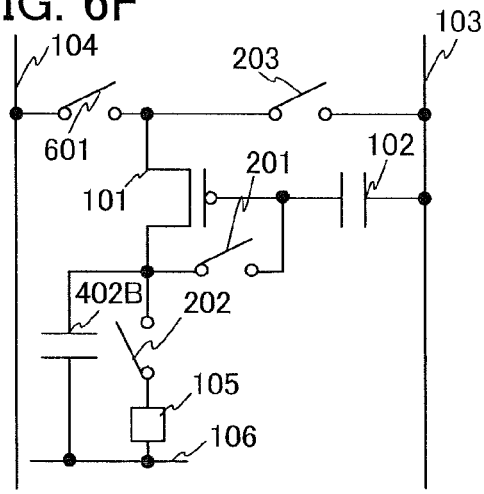

Further, FIG. 6F illustrates an example of FIGS. 4C and 4D. The first terminal of the capacitor element 402B is connected to the drain (or the source) of the transistor 101, and the second terminal is connected to the wiring 106.

As thus described, in FIGS. 6A to 6F, part of examples of the structure described in Embodiment Mode 1 is described; other examples can also be realized in a similar manner.

Next, an operation method is described. Here, description is made with use of the circuit in FIG. 6B. Similar operation can be applied to other circuits.

Figure 7A:
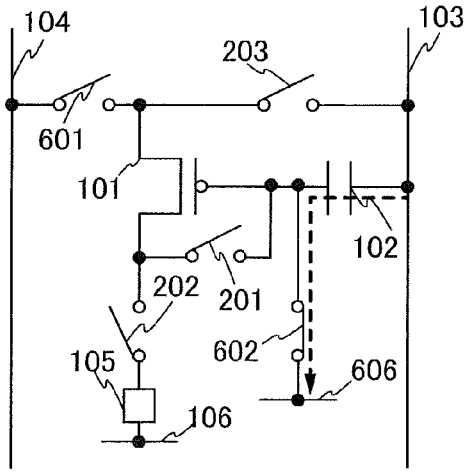
FIGS. 7A to 7D illustrate a circuit or a driving method described in an embodiment mode.

First, the circuit is initialized as illustrated in FIG. 7A. This is an operation that the potential of a gate or the drain (or the source) of the transistor 101 is set at a predetermined level. Therefore, such a state that the transistor 101 is turned on can be obtained. Alternatively, a predetermined voltage is supplied to the capacitor element 102. Therefore, charge is held in the capacitor element 102. The switch 602 is conducting and the switch 602 is in an on state. The switch 601, the switch 201, the switch 202, and the switch 203 are nonconducting, and it is preferable that they are in an off state. However, the state is not limited to this. Note that, since current does not preferably flow into the display element 105, a state by which such an operation can be realized is preferable. Thus, it is preferable that at least one of the switch 202 and the switch 203 be nonconducting and in an off state.

Note that it is preferable that the potential of the wiring 606 be lower than that of the wiring 104. Note that it is preferable that the potential of the wiring 606 be substantially the same as that of the wiring 106. Here, "substantially" means the state in which the potentials differ in the range of error, and refers to the case where the potentials are the same within the range of ±10%. Note that the potential is not limited to this. These potentials are used when the transistor 101 is a p-channel transistor. Thus, when the polarity of the transistor 101 is an n-channel type, it is preferable that the levels of the potentials can be reversed.

Figure 7B:
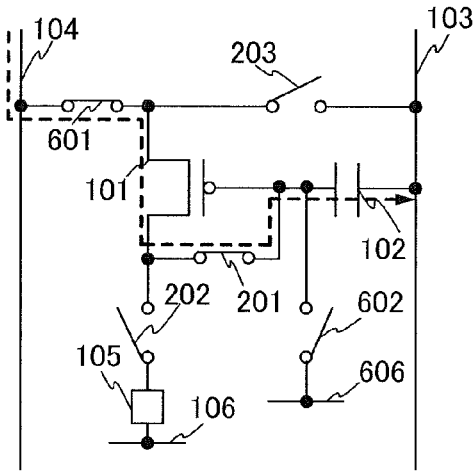

Next, an image signal is input as illustrated in FIG. 7B. Note that, in this period, the threshold voltage of the transistor 101 is also obtained. The switch 601 and the switch 201 are conducting and are in an on state. It is preferable that the switch 202, the switch 203, and the switch 602 are nonconducting and are in an off state. Then, an image signal is supplied from the wiring 104. Charge is stored in the capacitor element 102 in a period of FIG. 7A, so that the charge is discharged at that time. Therefore, the potential of the gate of the transistor 101 approaches the total potential of an image signal supplied from the wiring 104 and the threshold voltage (negative value) of the transistor 101 from the level of the image signal supplied from the wiring 104. In other words, the potential approaches a potential lower than the image signal supplied from the wiring 104 by the absolute value of the threshold voltage of the transistor 101. At that time, voltage between the gate and the source of the transistor 101 approaches the threshold voltage of the transistor 101. With this operation, input of the image signal and acquisition of the threshold voltage can be performed at the same time. Note that when charge in the capacitor element 102 is discharged, almost complete discharge of charge is possible. In that case, since current hardly flows into the transistor 101, the level of the voltage between the gate and the source of the transistor 101 is very close to the level of the threshold voltage of the transistor 101. Note that discharge can be stopped before charge is completely discharged.

With these operations, summed voltage of the voltage corresponding to the threshold voltage and the image signal voltage is supplied to the capacitor element 102, and charge corresponding to the voltage is stored.

Note that in this period, there is no big problem if the length of the period changes in the case where charge in the capacitor element 102 is discharged in this period. This is because, since charge is almost completely discharged after a certain amount of time, the influence on the operation is small even if the length of the period changes. Thus, not the line sequential driving but the dot sequential driving can be applied to the operation. Thus, the structure can be realized with a simple driving circuit structure. Therefore, when a circuit illustrated in FIGS. 6A to 6F is one pixel, both a pixel portion provided with pixels in matrix and a driving circuit portion which supplies a signal to the pixel portion can be formed using the same kind of a transistor or formed over the same substrate.

However, the structure is not limited to this. The case where the line sequential drive can be used and where the pixel portion and the driver circuit portion can be formed over different substrates is possible.

Figure 7C:
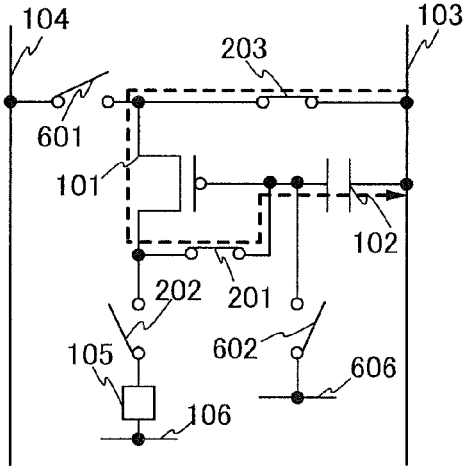

Next, variation in current characteristics such as mobility of the transistor 101 is compensated as illustrated in FIG. 7C. This corresponds to periods such as FIGS. 1A and 1C. Then, the switch 201 and the switch 203 are conducting and are in an on state. It is preferable that the switch 601, the switch 202, and the switch 602 be nonconducting and be in an off state. With such a state, charge stored in the capacitor element 102 is discharged through the transistor 101. In this way, charge is slightly discharged through the transistor 101, so that the influence of variation in current flowing into the transistor 101 can be reduced.

Figure 7D:
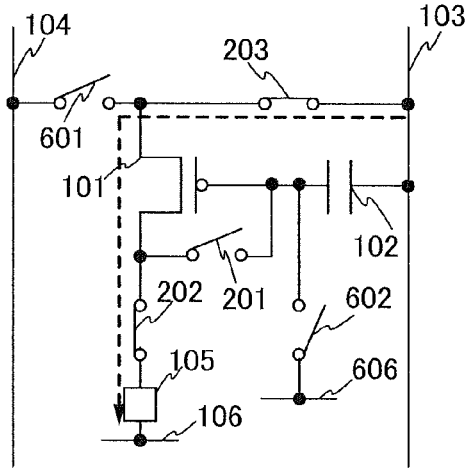

Next, as illustrated in FIG. 7D, current is supplied to the display element 105 through the transistor 101. This corresponds to periods such as FIGS. 1B and 1D. Then, the switch 202 and the switch 203 are conducting and are in an on state. It is preferable that the switch 201, the switch 601, and the switch 602 be nonconducting and be in an off state. At that time, the voltage between the gate and the source of the transistor 101 is at the voltage obtained by the voltage corresponding to current characteristics of the transistor 101 subtracted from total voltage of the voltage corresponding to the threshold voltage and image signal voltage. Thus, the influence of variation in current characteristics of the transistor 101 can be reduced, and appropriate amount of current can be supplied to the display element 105.

Figure 8A:
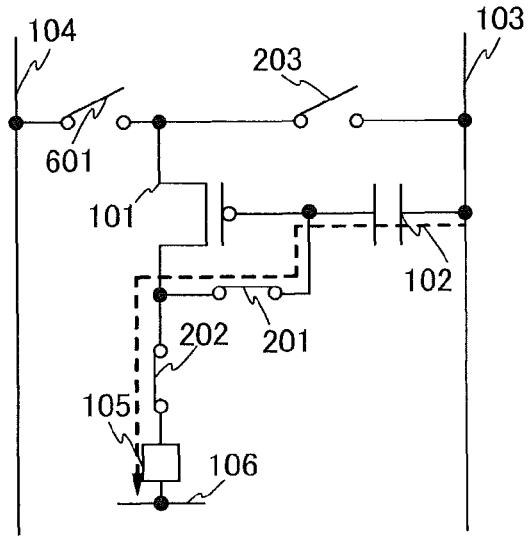
FIGS. 8A to 8C illustrate a circuit or a driving method described in an embodiment mode.

Note that in the case of the circuit configuration in FIG. 6A, in the period of initialization illustrated in FIG. 7A, the potential of the gate or the drain (or the source) of the transistor 101 can be controlled through the display element 105 as illustrated in FIG. 8A. Then, it is preferable that the switch 201 and the switch 202 be conducting and be in an on state. Although it is preferable that the switch 601 and the switch 203 be nonconducting and be in an off state, the state is not limited to this. Operation in and after FIG. 7B may be similar to the above operation.

Figure 8B:
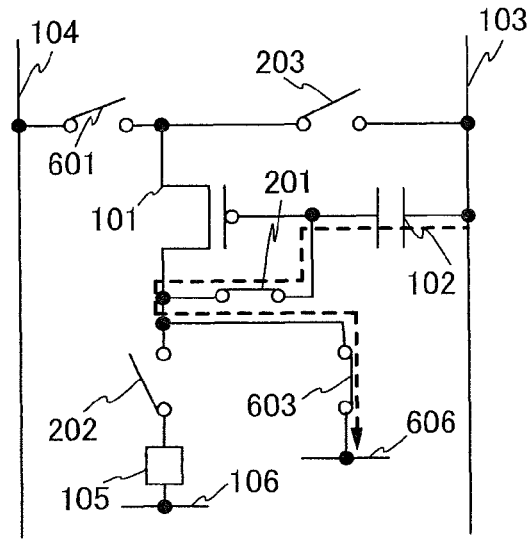

Alternatively, in the case of the circuit configuration in FIG. 6C, in the period of initialization illustrated in FIG. 7A, the potential of the gate or the drain (or the source) of the transistor 101 can be controlled through the switch 603 as illustrated in FIG. 8B. Then, it is preferable that the switch 201 and the switch 603 be conducting and be in an on state. Although it is preferable that the switch 601, the switch 202, and the switch 203 be nonconducting and be in an off state, the operation is not limited to this. Operation in and after FIG. 7B may be similar to the above operation.

Figure 8C:
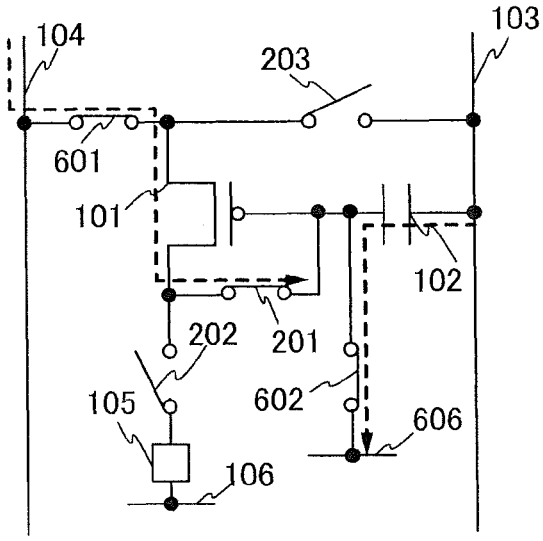

Note that in FIGS. 7A to 7D, another operation or another period can be provided between the operations, that is, when one operation proceeds to a next operation. For example, the state as illustrated in FIG. 8C may be provided between FIG. 7A and FIG. 7B. Since there is no harm in providing such a period, there is no problem.

Note that the contents described with each drawing in this embodiment mode can be freely combined with or replaced with the contents described in another embodiment mode as appropriate.

Embodiment Mode 3

This embodiment mode will describe a specific example of the circuit and the driving method described in Embodiment Mode 1.

Figure 9A:
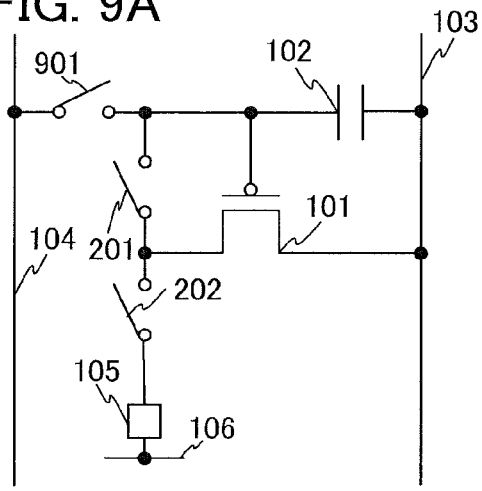
FIGS. 9A to 9E illustrate a circuit or a driving method described in an embodiment mode.

FIG. 9A illustrates a specific example of FIGS. 1A and 1B, and FIG. 2A. A first terminal of a switch 901 is connected to the wiring 104, and a second terminal is connected to the gate of the transistor 101. The first terminal of the capacitor element 102 is connected to the gate of the transistor 101, and the second terminal is connected to the wiring 103. The first terminal of the switch 201 is connected to the gate of the transistor 101, and the second terminal is connected to the drain (or the source) of the transistor 101. The first terminal of the switch 202 is connected to the drain (or the source) of the transistor 101, and the second terminal is connected to the first terminal of the display element 105. The second terminal of the display element 105 is connected to the wiring 106. The source (or the drain) of the transistor 101 is connected to the wiring 103.

Note that the connection structure of the circuit is not limited to this. As long as elements are provided so as to desirably operate, various circuit configurations can be realized by providing a switch, a transistor, or the like in various places.

Figure 9B:
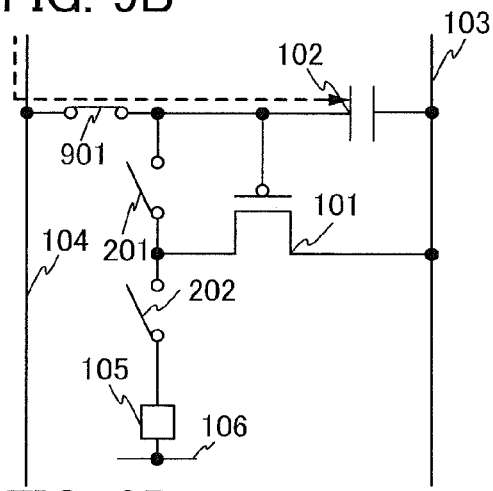
Figure 9C:
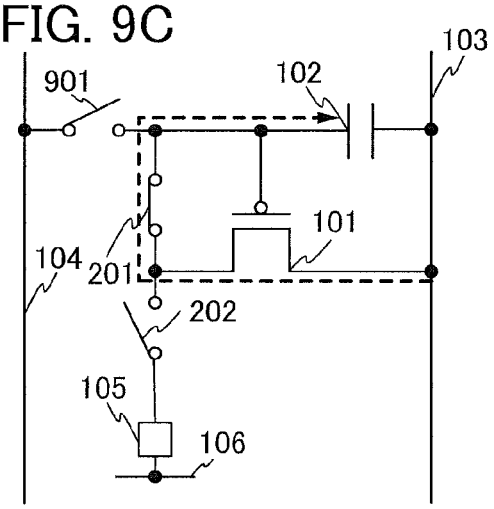
Figure 9D:
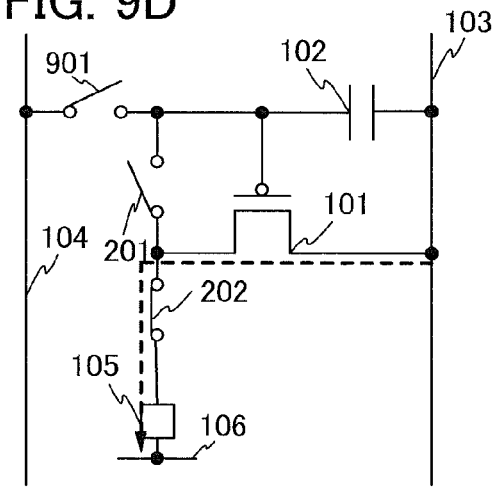
Figure 9E:
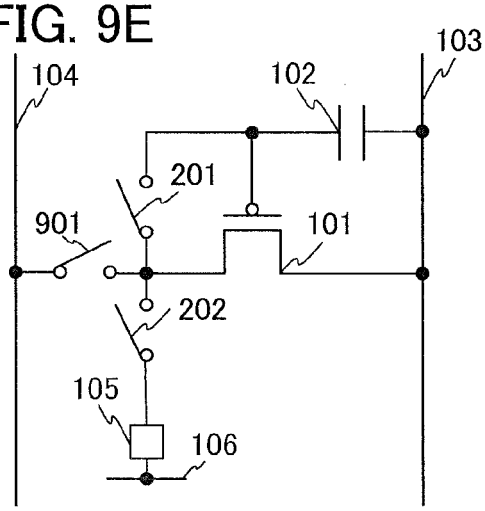

For example, as illustrated in FIG. 9E, a connection of the switch 901 can be changed. In FIG. 9E, the first terminal of the switch 901 is connected to the wiring 104, and the second terminal is connected to the drain (or the source) of the transistor 101.

As thus described, an example of the structure described in Embodiment Mode 1 can take various structures. Further, a specific example of FIGS. 1A and 1B, and FIG. 2A are described; similarly, specific examples of FIGS. 1A to 1H, FIGS. 2A to 2F, FIGS. 4A to 4F, and FIGS. 5A to 5D can be realized.

Next, operation is described.

First, as illustrated in FIG. 9B, an image signal is input. The switch 901 is conducting and is in an on state. It is preferable that the switch 201 and the switch 202 be nonconducting and be in an off state. Then, an image signal is supplied from the wiring 104. At that time, charge is stored in the capacitor element 102.

Next, variation in current characteristics such as mobility of the transistor 101 is compensated as illustrated in FIG. 9C. This corresponds to periods such as FIGS. 1A and 1C. Then, the switch 201 is conducting and is in an on state. It is preferable that the switch 901 and the switch 202 be nonconducting and be in an off state. With such a state, charge stored in the capacitor element 102 is discharged through the transistor 101. In this way, charge is slightly discharged through the transistor 101, so that the influence of variation in current flowing into the transistor 101 can be reduced.

Next, as illustrated in FIG. 9D, current is supplied to the display element 105 through the transistor 101. This corresponds to periods such as FIGS. 1B and 1D. Then, the switch 202 is conducting and is in an on state. It is preferable that the switch 201 and the switch 901 be nonconducting and be in an off state. At that time, the voltage between the source and the gate of the transistor 101 is at the voltage obtained by voltage corresponding to current characteristics of the transistor 101 subtracted from image signal voltage. Thus, the influence of variation in current characteristics of the transistor 101 can be reduced, and appropriate amount of current can be supplied to the display element 105.

Note that in the case of the circuit configuration of FIG. 9E, it is preferable that the switch 201 and the switch 901 be conducting and be in an on state in the period of FIG. 9B. Operation in and after FIG. 9C may be similar to the above operation.

Note that in FIGS. 9A to 9E, another operation or another period can be provided between the operations, that is, when one operation proceeds to a next operation.

Note that the contents described with each drawing in this embodiment mode can be freely combined with or replaced with the contents described in another embodiment mode as appropriate.

Embodiment Mode 4

This embodiment mode will describe a specific example of the circuits described in Embodiment Mode 1 to Embodiment Mode 3.

Figure 10:
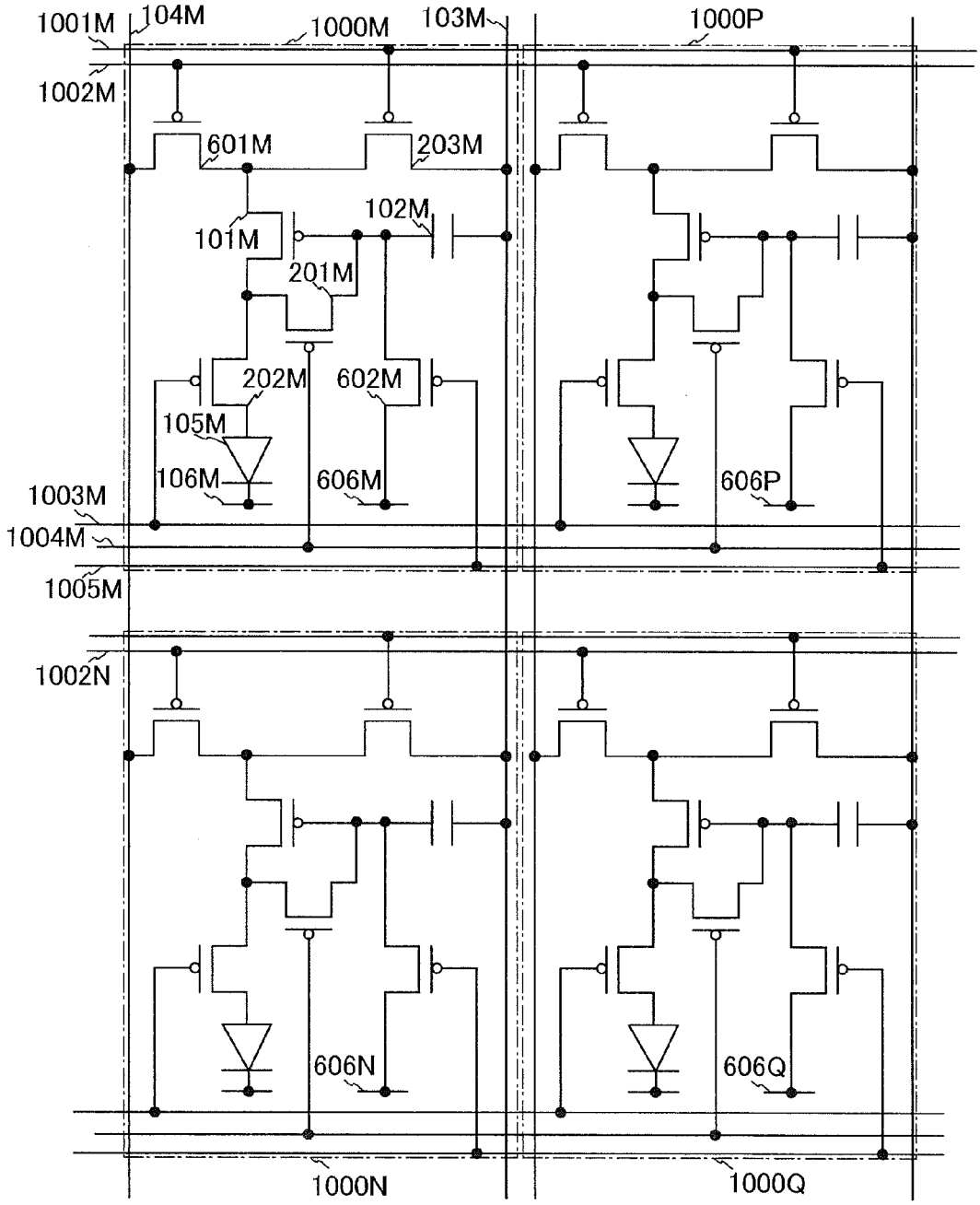
FIG. 10 illustrates a circuit or a driving method described in an embodiment mode.

As an example, FIG. 10 illustrates the case where the circuit illustrated in FIG. 6B forms one pixel, and the pixels are provided in matrix. Note that a p-channel transistor is used as switches in FIG. 10. However, the polarity is not limited to this. A transistor having the other polarity, both polarities of transistors, a diode, a diode-connected transistor, or the like can be used.

The circuit illustrated in FIG. 6B forms a pixel 1000M which is one pixel. A pixel 1000N, a pixel 1000P, and a pixel 1000Q which are pixels having a structure similar to that of the pixel 1000M are provided in matrix. Pixels may be connected to the same wiring in some cases, according to the arrangement of pixels, that is, whether a pixel is arranged on the left, the right, the top, or the bottom.

Next, correspondence between each element in FIG. 6B and each element in the pixel 1000M is described below. The wiring 104 corresponds to a wiring 104M. The wiring 103 corresponds to a wiring 103M. The switch 601 corresponds to a transistor 601M. The switch 203 corresponds to a transistor 203M. The transistor 101 corresponds to a transistor 101M. The capacitor element 102 corresponds to a capacitor element 102M. The switch 201 corresponds to a transistor 201M. The switch 202 corresponds to a transistor 202M. The switch 602 corresponds to a transistor 602M. The display element 105 corresponds to a light-emitting element 105M. The wiring 106 corresponds to a wiring 106M. The wiring 606 corresponds to a wiring 606M.

A gate of the transistor 601M is connected to a wiring 1002M. A gate of the transistor 203M is connected to a wiring 1001M. A gate of the transistor 202M is connected to a wiring 1003M. A gate of the transistor 201M is connected to a wiring 1004M. A gate of the transistor 602M is connected to a wiring 1005M.

Note that wirings which are connected to a gate of a transistor can be connected to a wiring of another pixel or another wiring of the same pixel. For example, the gate of the transistor 602M can be connected to a wiring 1002N included in the pixel 1000N. In this case, the wiring 1002N also can be used as a wiring 1005M, so that the wiring 1005M can be deleted.

Note that the case of using the transistor 602M which has three terminals or four terminals as the switch 602 is described. Alternatively, a diode having two terminals or a diode-connected transistor can be used. When these elements are used, the wiring 1005M which controls on or off of the transistor 602M can be deleted.

Note that the wiring 606M can be connected to a wiring 606P, a wiring 606N, a wiring 606Q, and a wiring 106M. Alternatively, the wiring 606M can be connected to a wiring included in another pixel.

Various circuits can be configured in the manner similar to FIG. 10.

Note that the contents described with each drawing in this embodiment mode can be freely combined with or replaced with the contents described in another embodiment mode as appropriate.

Embodiment Mode 5

This embodiment mode will describe a structure and a manufacturing method of a transistor.

Figure 11A:
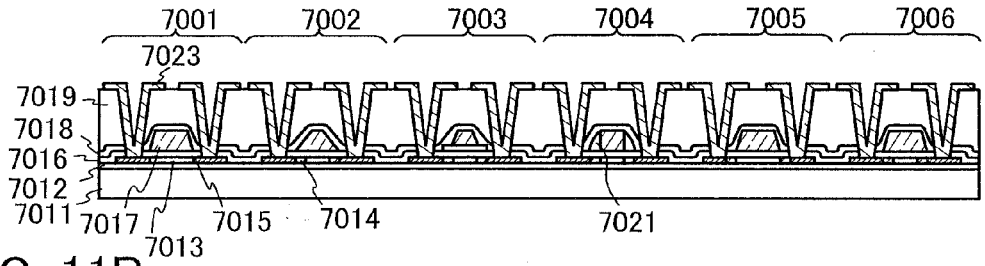
FIGS. 11A to 11G illustrate a cross-sectional view of a transistor described in an embodiment mode.
Figure 11B:
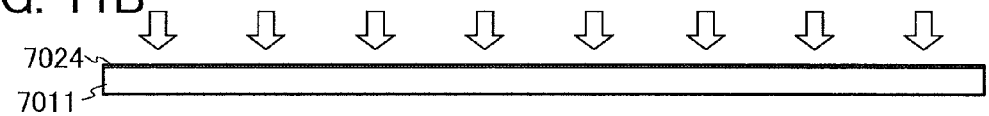
Figure 11C:
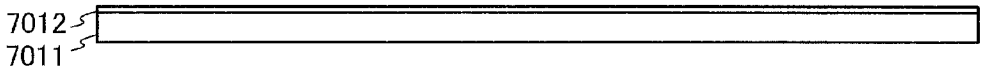
Figure 11D:
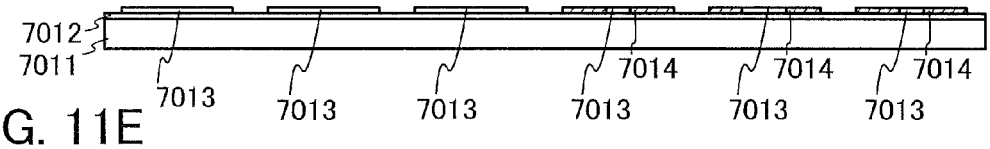
Figure 11E:
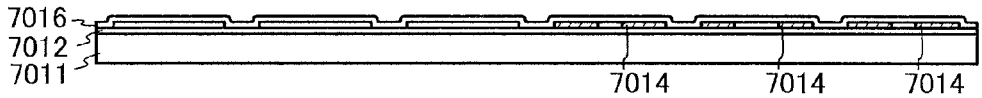
Figure 11F:
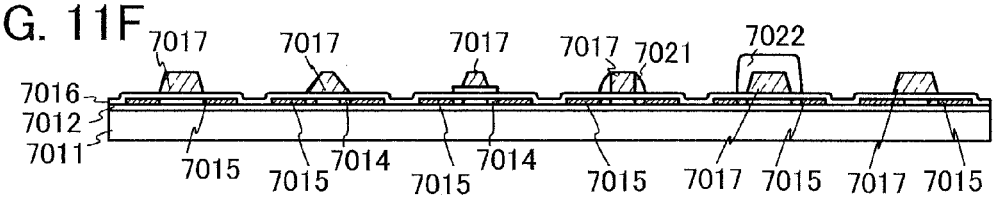
Figure 11G:
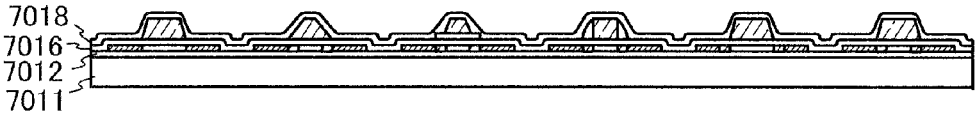

FIGS. 11A to 11G illustrate a structure and a manufacturing method of a transistor. FIG. 11A illustrates a structure example of a transistor. FIGS. 11B to 11G illustrate an example of a manufacturing method of the transistor.

Note that the structure and the manufacturing method of a transistor are not limited to those illustrated in FIGS. 11A to 11G, and various structures and manufacturing methods can be employed.

First, a structure example of a transistor is described with reference to FIG. 11A. FIG. 11A is a cross-sectional view of a plurality of transistors each having a different structure. Here, in FIG. 11A, the plurality of transistors each having a different structure are juxtaposed, which is for describing structures of the transistors. Therefore, the transistors are not needed to be actually juxtaposed as illustrated in FIG. 11A and can be separately formed as needed.

Next, characteristics of each layer forming the transistor are described.

A substrate 7011 can be a glass substrate using barium borosilicate glass, aluminoborosilicate glass, or the like, a quartz substrate, a ceramic substrate, a metal substrate containing stainless steel, or the like. In addition, a substrate formed of plastics typified by polyethylene terephthalate (PET), polyethylene naphthalate (PEN), or polyethersulfone (PES), or a substrate formed of a flexible synthetic resin such as acrylic can also be used. By using a flexible substrate, a semiconductor device capable of being bent can be formed. A flexible substrate has no strict limitations on an area or a shape of the substrate. Therefore, for example, when a substrate having a rectangular shape, each side of which is 1 meter or more, is used as the substrate 7011, productivity can be significantly improved. Such an advantage is highly favorable as compared with the case where a circular silicon substrate is used.

An insulating film 7012 functions as a base film and is provided to prevent alkali metal such as Na or alkaline earth metal from the substrate 7011 from adversely affecting characteristics of a semiconductor element. The insulating film 7012 can have a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y). For example, when the insulating film 7012 is provided to have a two-layer structure, it is preferable that a silicon nitride oxide film be used as a first insulating film and a silicon oxynitride film be used as a second insulating film. As another example, when the insulating film 7012 is provided to have a three-layer structure, it is preferable that a silicon oxynitride film be used as a first insulating film, a silicon nitride oxide film be used as a second insulating film, and a silicon oxynitride film be used as a third insulating film.

Semiconductor layers 7013, 7014, and 7015 can be formed using an amorphous semiconductor, a microcrystalline semiconductor, or a semi-amorphous semiconductor (SAS). Alternatively, a polycrystalline semiconductor layer may be used. SAS is a semiconductor having an intermediate structure between amorphous and crystalline (including single crystal and polycrystalline) structures and having a third state which is stable in free energy. Moreover, SAS includes a crystalline region with a short-range order and lattice distortion. A crystalline region of 0.5 to 20 nm can be observed at least in part of a film. When silicon is contained as a main component, Raman spectrum shifts to a wave number side lower than 520

$cm^{-1}$. The diffraction peaks of (111) and (220), which are thought to be derived from a silicon crystalline lattice, are observed by X-ray diffraction. SAS contains hydrogen or halogen of at least 1 atomic % or more to compensate dangling bonds. SAS is formed by glow discharge decomposition (plasma CVD) of a material gas. As the material gas, $SiH_4$, $Si_2H_6$, $SiH_2Cl_2$, $SiHCl_3$, $SiCl_4$, $SiF_4$, or the like can be used. Further, $GeF_4$ may be mixed. Alternatively, the material gas may be diluted with $H_2$, or $H_2$ and one or more kinds of rare gas elements selected from He, Ar, Kr, and Ne. A dilution ratio is in the range of 2 to 1000 times. Pressure is in the range of approximately 0.1 to 133 Pa, and a power supply frequency is 1 to 120 MHz, preferably 13 to 60 MHz. A substrate heating temperature may be 300° C. or lower. A concentration of impurities in atmospheric components such as oxygen, nitrogen, and carbon is preferably $1\times10^{20}$ $cm^{-1}$ or less as impurity elements in the film. In particular, an oxygen concentration is $5\times10^{19}/cm^3$ or less, preferably $1\times10^{19}/cm^3$ or less. Here, an amorphous semiconductor layer is formed using a material containing silicon (Si) as its main component (e.g., $Si_xGe_{1-x}$) by a sputtering method, an LPCVD method, a plasma CVD method, or the like. Then, the amorphous semiconductor layer is crystallized by a crystallization method such as a laser crystallization method, a thermal crystallization method using RTA or an annealing furnace, or a thermal crystallization method using a metal element which promotes crystallization.

An insulating film 7016 can have a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y).

A gate electrode 7017 can have a single-layer structure of a conductive film or a stacked-layer structure of two or three conductive films. As a material for the gate electrode 7017, a conductive film can be used. For example, a single film of an element such as tantalum (Ta), titanium (Ti), molybdenum (Mo), tungsten (W), chromium (Cr), silicon (Si), or the like; a nitride film containing the aforementioned element (typically, a tantalum nitride film, a tungsten nitride film, or a titanium nitride film); an alloy film in which the aforementioned elements are combined (typically, a Mo—W alloy or a Mo—Ta alloy); a silicide film containing the aforementioned element (typically, a tungsten silicide film or a titanium silicide film); and the like can be used. Note that the aforementioned single film, nitride film, alloy film, silicide film, and the like can have a single-layer structure or a stacked-layer structure.

An insulating film 7018 can have a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y); or a film containing carbon, such as a DLC (Diamond-Like Carbon), by a sputtering method, a plasma CVD method, or the like.

An insulating film 7019 can have a single-layer structure or a stacked-layer structure of a siloxane resin; an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y); a film containing carbon, such as a DLC (Diamond-Like Carbon); or an organic material such as epoxy, polyimide, polyamide, polyvinyl phenol, benzocyclobutene, or acrylic. Note that a siloxane resin corresponds to a resin having Si—O—Si bonds. Siloxane includes a skeleton structure of a bond of silicon (Si) and oxygen (O). As a substituent, an organic group containing at least hydrogen (such as an alkyl group or aromatic hydrocarbon) is used. A fluoro group can also be used as a substituent. Alternatively, a fluoro group, or a fluoro group and an organic group containing at least hydrogen can be used as a substituent. Note that the insulating film 7019 can be provided to cover the gate electrode 7017 directly without provision of the insulating film 7018.

As a conductive film 7023, a single film of an element such as Al, Ni, C, W, Mo, Ti, Pt, Cu, Ta, Au, Mn, or the like, a nitride film containing the aforementioned element, an alloy film in which the aforementioned elements are combined, a silicide film containing the aforementioned element, or the like can be used. For example, as an alloy containing a plurality of the aforementioned elements, an Al alloy containing C and Ti, an Al alloy containing Ni, an Al alloy containing C and Ni, an Al alloy containing C and Mn, or the like can be used. When the conductive film has a stacked-layer structure, a structure can be such that Al is interposed between Mo, Ti, or the like; thus, resistance of Al to heat and chemical reaction can be improved.

Next, characteristics of each structure are described with reference to the cross-sectional view of the plurality of transistors each having a different structure in FIG. 11A.

A transistor 7001 is a single drain transistor. Since it can be formed by a simple method, it is advantageous in low manufacturing cost and high yield. Note that a tapered angle is 45° or more and less than 95°, and preferably, 60° or more and less than 95°. The tapered angle may be less than 45°. Here, the semiconductor layers 7013 and 7015 have different concentrations of impurities, and the semiconductor layer 7013 is used as a channel region and the semiconductor layers 7015 are used as a source region and a drain region. By controlling the concentration of impurities in this manner, resistivity of the semiconductor layer can be controlled. Further, an electrical connection state of the semiconductor layer and the conductive film 7023 can be closer to ohmic contact. Note that as a method of separately forming the semiconductor layers each having different amount of impurities, a method where impurities are doped in the semiconductor layer using the gate electrode 7017 as a mask can be used.

In a transistor 7002, the gate electrode 7017 is tapered at an angle of at least certain degrees. Since it can be formed by a simple method, it is advantageous in low manufacturing cost and high yield. Here, the semiconductor layers 7013, 7014, and 7015 have different concentrations of impurities. The semiconductor layer 7013 is used as a channel region, the semiconductor layers 7014 as lightly doped drain (LDD) regions, and the semiconductor layers 7015 as a source region and a drain region. By controlling the amount of impurities in this manner, resistivity of the semiconductor layer can be controlled. Further, an electrical connection state of the semiconductor layer and the conductive film 7023 can be closer to ohmic contact. Moreover, since the transistor includes the LDD regions, high electric field is hardly applied inside the transistor, so that deterioration of the element due to hot carriers can be suppressed. Note that as a method of separately forming the semiconductor layers having different amount of impurities, a method where impurities are doped in the semiconductor layer using the gate electrode 7017 as a mask can be used. In the transistor 7002, since the gate electrode 7017 is tapered at an angle of at least certain degrees, gradient of the concentration of impurities doped in the semiconductor layer through the gate electrode 7017 can be provided, and the LDD region can be easily formed. Note that the tapered angle is 45° or more and less than 95°, and preferably, 60° or more and less than 95°. Alternatively, the tapered angle can be less than 45°.

A transistor 7003 has a structure where the gate electrode 7017 is formed of at least two layers and a lower gate electrode is longer than an upper gate electrode. In this specification, a shape of the lower and upper gate electrodes is called a hat shape. When the gate electrode 7017 has a hat shape, an LDD region can be formed without addition of a photomask. Note that a structure where the LDD region overlaps with the gate electrode 7017, like the transistor 7003, is particularly called a GOLD (Gate Overlapped LDD) structure. Note that as a method of forming the gate electrode 7017 with a hat shape, the following method may be used.

First, when the gate electrode 7017 is patterned, the lower and upper gate electrodes are etched by dry etching so that side surfaces thereof are inclined (tapered). Then, an inclination of the upper gate electrode is processed to be almost perpendicular by anisotropic etching. Thus, the gate electrode having a cross section of which is a hat shape is formed. After that, impurity elements are doped twice, so that the semiconductor layer 7013 used as the channel region, the semiconductor layers 7014 used as the LDD regions, and the semiconductor layers 7015 used as a source region and a drain region are formed.

Note that part of the LDD region, which overlaps with the gate electrode 7017, is referred to as an Lov region, and part of the LDD region, which does not overlap with the gate electrode 7017, is referred to as an Loff region. The Loff region is highly effective in suppressing an off-current value, whereas it is not very effective in preventing deterioration in an on-current value due to hot carriers by relieving an electric field in the vicinity of the drain. On the other hand, the Lov region is highly effective in preventing deterioration in the on-current value by relieving the electric field in the vicinity of the drain, whereas it is not very effective in suppressing the off-current value. Thus, it is preferable to form a transistor having a structure appropriate for characteristics of each of the various circuits. For example, when a semiconductor device is used for a display device, a transistor having an Loff region is preferably used as a pixel transistor in order to suppress the off-current value. On the other hand, as a transistor in a peripheral circuit, a transistor having an Lov region is preferably used in order to prevent deterioration in the on-current value by relieving the electric field in the vicinity of the drain.

A transistor 7004 includes a sidewall 7021 in contact with the side surface of the gate electrode 7017. When the transistor includes the sidewall 7021, a region overlapping with the sidewall 7021 can be made to be an LDD region.

In a transistor 7005, an LDD (Loft) region is formed by doping in the semiconductor layer with the use of a mask 7022. Thus, the LDD region can surely be formed, and an off-current value of the transistor can be reduced.

In a transistor 7006, an LDD (Lov) region is formed by doping in the semiconductor layer with the use of a mask. Thus, the LDD region can surely be formed, and deterioration in an on-current value can be suppressed by relieving the electric field in the vicinity of the drain of the transistor.

Next, an example of a method for manufacturing a transistor is described with reference to FIGS. 11B to 11G.

Note that a structure and a manufacturing method of a transistor are not limited to those in FIGS. 11A to 11G, and various structures and manufacturing methods can be used.

In this embodiment mode, surfaces of the substrate 7011, the insulating film 7012, the semiconductor layers 7013, 7014, and 7015, the insulating film 7016, the insulating film 7018, or the insulating film 7019 are oxidized or nitrided by plasma treatment, so that the semiconductor layer or the insulating film can be oxidized or nitrided. By oxidizing or nitriding the semiconductor layer or the insulating film by plasma treatment in such a manner, a surface of the semiconductor layer or the insulating film is modified, and the insulating film can be formed to be denser than an insulating film formed by a CVD method or a sputtering method. Thus, a defect such as a pinhole can be suppressed, and characteristics and the like of a semiconductor device can be improved. Note that an insulating film 7024 formed by plasma treatment is referred to as a plasma-treated insulating film.

Note that silicon oxide ($SiO_x$) or silicon nitride ($SiN_x$) can be used for the sidewall 7021. As a method of forming the sidewall 7021 on the side surface of the gate electrode 7017, a method where a silicon oxide ($SiO_x$) film or a silicon nitride ($SiN_x$) film is formed after the gate electrode 7017 is formed, and then, the silicon oxide ($SiO_x$) film or the silicon nitride ($SiN_x$) film is etched by anisotropic etching can be used, for example. Thus, the silicon oxide ($SiO_x$) film or the silicon nitride ($SiN_x$) film remains only on the side surface of the gate electrode 7017, so that the sidewall 7021 can be formed on the side surface of the gate electrode 7017.

The above is the description of the structures and manufacturing methods of transistors. Here, a wiring, an electrode, a conductive layer, a conductive film, a terminal, a via, a plug, and the like are preferably formed of one or more elements selected from aluminum (Al), tantalum (Ta), titanium (Ti), molybdenum (Mo), tungsten (W), neodymium (Nd), chromium (Cr), nickel (Ni), platinum (Pt), gold (Au), silver (Ag), copper (Cu), magnesium (Mg), scandium (Sc), cobalt (Co), zinc (Zn), niobium (Nb), silicon (Si), phosphorus (P), boron (B), arsenic (As), gallium (Ga), indium (In), tin (Sn), and oxygen (O); or a compound or an alloy material including one or more of the aforementioned elements (e.g., indium tin oxide (ITO), indium zinc oxide (IZO), indium tin oxide containing oxide silicon (ITSO), zinc oxide (ZnO), tin oxide (SnO), cadmium tin oxide (CTO), aluminum neodymium (Al—Nd), magnesium silver (Mg—Ag), or molybdenum-niobium (Mo—Nb)); a substance in which these compounds are combined; or the like. Alternatively, they are preferably formed to contain a substance including a compound (silicide) of silicon and one or more of the aforementioned elements (e.g., aluminum silicon, molybdenum silicon, or nickel silicide); or a compound of nitrogen and one or more of the aforementioned elements (e.g., titanium nitride, tantalum nitride, or molybdenum nitride).

Note that silicon (Si) may contain an n-type impurity (such as phosphorus) or a p-type impurity (such as boron). When silicon contains the impurity, the conductivity is increased, and a function similar to a general conductor can be realized. Thus, such silicon can be utilized easily as a wiring, an electrode, or the like.

In addition, silicon with various levels of crystallinity, such as single crystalline silicon, polycrystalline silicon, or microcrystalline silicon can be used. Alternatively, silicon having no crystallinity, such as amorphous silicon can be used. By using single crystalline silicon or polycrystalline silicon, resistance of a wiring, an electrode, a conductive layer, a conductive film, a terminal, or the like can be reduced. By using amorphous silicon or microcrystalline silicon, a wiring or the like can be formed by a simple process.

Note that aluminum and silver have high conductivity, and thus can reduce a signal delay. Further, since aluminum and silver can be easily etched and patterned, they can be minutely processed.

Note that copper has high conductivity, and thus can reduce a signal delay. When copper is used, a stacked-layer structure is preferably employed to improve adhesion.

Note that Molybdenum and titanium are preferable since even if molybdenum or titanium is in contact with an oxide semiconductor (e.g., ITO or IZO) or silicon, molybdenum or titanium does not cause defects. Further, molybdenum and titanium are preferable since they are easily etched and have high heat resistance.

Note that tungsten is preferable since it has an advantage such as high heat resistance.

Neodymium is also preferable since it has an advantage such as high heat resistance. In particular, when an alloy of neodymium and aluminum is used, heat resistance is increased and aluminum hardly causes hillocks.

Silicon is preferable since it can be formed at the same time as a semiconductor layer included in a transistor and has high heat resistance.

Since ITO, IZO, ITSO, zinc oxide (ZnO), silicon (Si), tin oxide (SnO), and cadmium tin oxide (CTO) have light-transmitting properties, they can be used as a portion which transmits light. For example, they can be used for a pixel electrode or a common electrode.

IZO is preferable since it is easily etched and processed. In etching IZO, a residue is hardly left. Thus, when IZO is used for a pixel electrode, defects (such as short circuit or orientation disorder) of a liquid crystal element or a light-emitting element can be reduced.

A wiring, an electrode, a conductive layer, a conductive film, a terminal, a via, a plug, or the like may have a single-layer structure or a multi-layer structure. By employing a single-layer structure, each manufacturing process of a wiring, an electrode, a conductive layer, a conductive film, a terminal, or the like can be simplified, the number of days for a process can be reduced, and cost can be reduced. Alternatively, by employing a multi-layer structure, a wiring, an electrode, and the like with high performance can be formed while an advantage of each material is utilized and a disadvantage thereof is reduced. For example, when a low-resistant material (e.g., aluminum) is included in a multi-layer structure, reduction in resistance of a wiring can be realized. As another example, when a stacked-layer structure where a low heat-resistant material is interposed between high heat-resistant materials is employed, heat resistance of a wiring, an electrode, and the like can be increased, utilizing advantages of the low heat-resistance material. For example, it is preferable to employ a stacked-layer structure where a layer containing aluminum is interposed between layers containing molybdenum, titanium, neodymium, or the like.

When wirings, electrodes, or the like are in direct contact with each other, they adversely affect each other in some cases. For example, one wiring or one electrode is mixed into a material of another wiring or another electrode and changes its properties, and thus, an intended function cannot be obtained. As another example, when a high-resistant portion is formed, a problem may occur so that it cannot be normally formed. In such cases, a reactive material is preferably interposed by or covered with a non-reactive material in a stacked-layer structure. For example, when ITO and aluminum are connected, titanium, molybdenum, or an alloy of neodymium is preferably interposed between ITO and aluminum. As another example, when silicon and aluminum are connected, titanium, molybdenum, or an alloy of neodymium is preferably interposed between silicon and aluminum.

The term "wiring" indicates a portion including a conductor. A wiring may be a linear shape or may be short without a linear shape. Therefore, an electrode is included in a wiring.

Note that the contents described with each drawing in this embodiment mode can be freely combined with or replaced with the contents described in another embodiment mode as appropriate.

Embodiment Mode 6

This embodiment mode will describe examples of electronic devices.

FIGS. 12A to 12H and FIGS. 13A to 13D illustrate electronic devices. These electronic devices can each include a housing 9630, a display portion 9631, a speaker 9633, an LED lamp 9634, operation keys 9635, a connection terminal 9636, a sensor 9637 (having a function to measure power, displacement, position, speed, acceleration, angular velocity, the number of rotations, distance, light, liquid, magnetism, temperature, a chemical substance, sound, time, hardness, an electric field, current, voltage, electric power, radiation, a flow rate, humidity, gradient, oscillation, smell, or infrared ray), a microphone 9638, and the like.

Figure 12A:
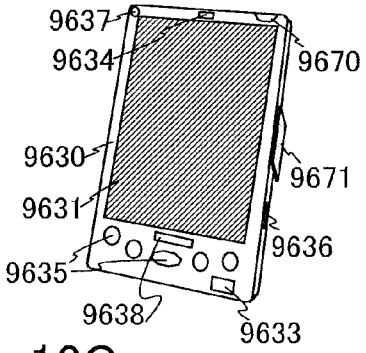
FIGS. 12A to 12H illustrate electronic devices described in an embodiment mode.
Figure 12B:
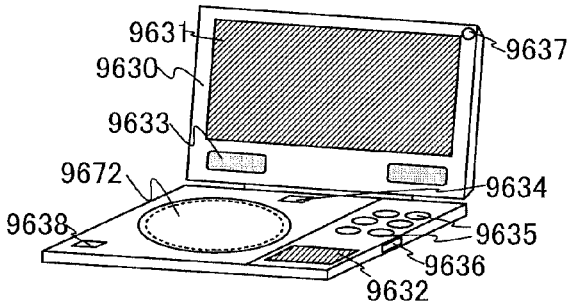
Figure 12C:
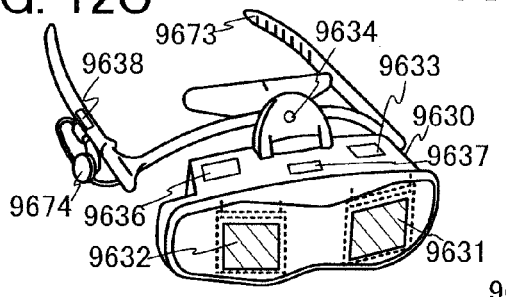
Figure 12D:
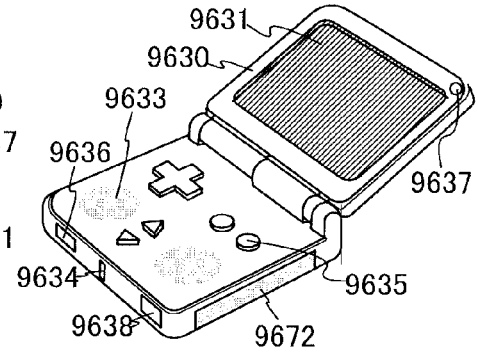
Figure 12E:
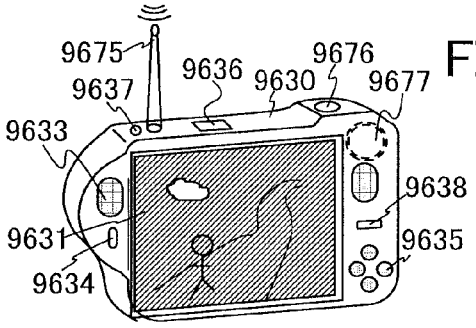
Figure 12F:
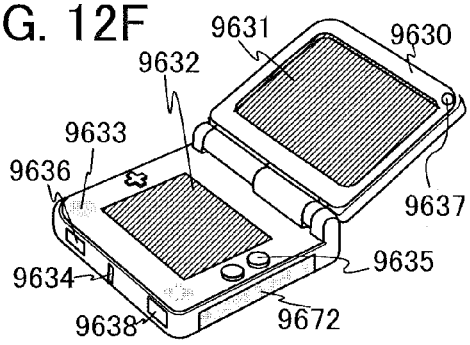
Figure 12G:
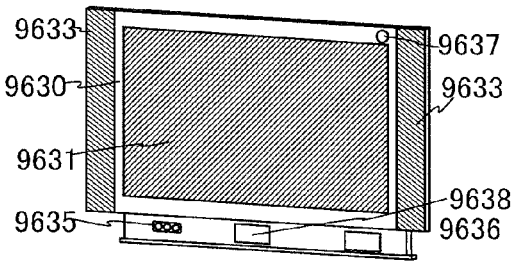
Figure 12H:
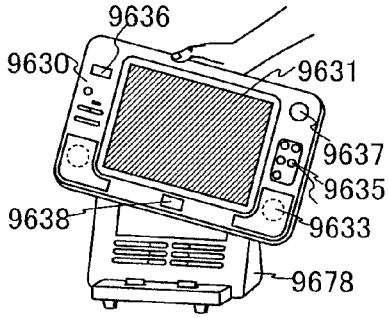
Figure 13A:
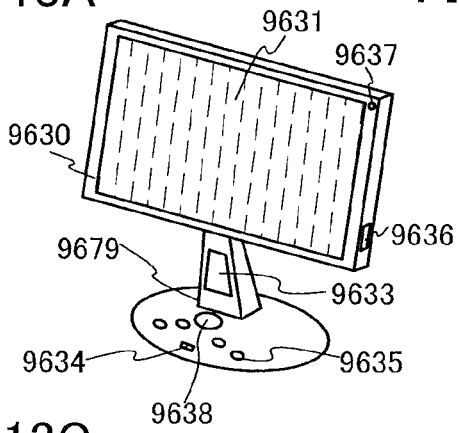
FIGS. 13A to 13H illustrate electronic devices described in an embodiment mode.
Figure 13B:
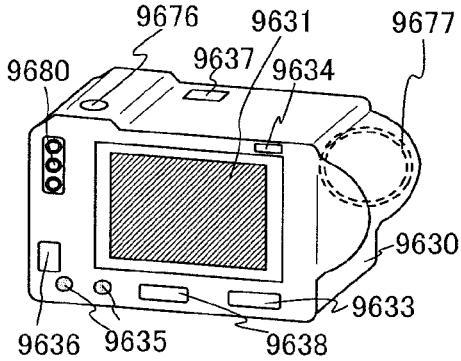
Figure 13C:
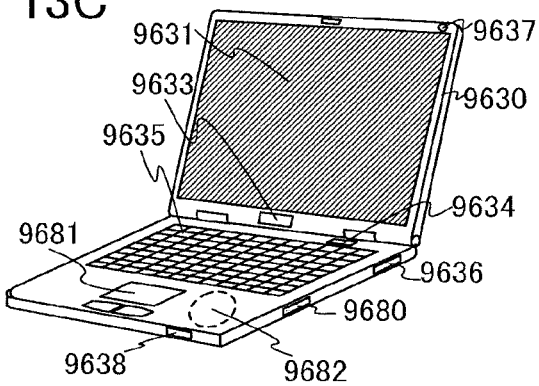
Figure 13D:
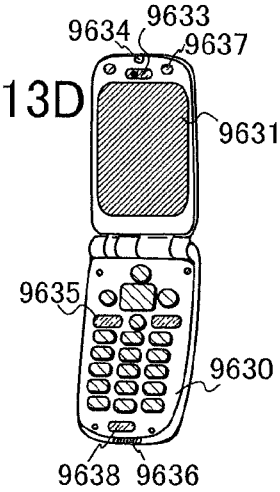

FIG. 12A illustrates a mobile computer which can include a switch 9670, an infrared port 9671, and the like in addition to the above mentioned components. FIG. 12B illustrates a portable image reproducing device having a recording medium (e.g., a DVD reproducing device), which can include a second display portion 9632, a recording medium reading portion 9672, and the like in addition to the above mentioned components. FIG. 12C illustrates a goggle-type display which can include a second display portion 9632, a supporting portion 9673, an earphone 9674, and the like in addition to the above mentioned components. FIG. 12D illustrates a portable game machine which can include a recording medium reading portion 9672 and the like in addition to the above mentioned components. FIG. 12E illustrates a digital camera having a television reception function which can include an antenna 9675, a shutter button 9676, an image receiving portion 9677, and the like in addition to the above mentioned components. FIG. 12F illustrates a portable game machine which can include a second display portion 9632, a recording medium reading portion 9672, and the like in addition to the above mentioned components. FIG. 12G illustrates a television receiver which can include a tuner, an image processing portion, and the like in addition to the above mentioned components. FIG. 12H illustrates a portable television receiver which can include a charger 9678 capable of transmitting and receiving a signal and the like in addition to the above mentioned components. FIG. 13A illustrates a display which can include a support base 9679 and the like in addition to the above mentioned components. FIG. 13B illustrates a camera which can include an external connection port 9680, a shutter button 9676, an image receiving portion 9677, and the like in addition to the above mentioned components. FIG. 13C illustrates a computer which can include a pointing device 9681, an external connection port 9680, a reader/writer 9682, and the like in addition to the above mentioned components. FIG. 13D illustrates a mobile phone which can include a transmitting portion, a reception portion, a tuner of reception service of one segment portion for a mobile phone and a mobile terminal, and the like in addition to the above mentioned components.

Electronic devices illustrated in FIGS. 12A to 12H and FIGS. 13A to 13D can have various functions. The functions include a function to display various kinds of information (e.g., a still image, a moving image, and a text image) on the display portion; a touch panel function; a function to display a calendar, a date, the time, and the like; a function to control processing by various kinds of software (programs); a wireless communication function; a function to connect with various computer networks by using the wireless communication function; a function to transmit or receive various kinds of data by using the wireless communication function; a function to read a program or data recorded in the recording medium and to display it on the display portion; and the like. Further, in an electronic device having a plurality of display portions, a function to mainly display image information on one display portion and to mainly display text information on another display portion; a function to display a three-dimensional image by displaying an image on a plurality of display portions in consideration of parallax; or the like is included. Furthermore, an electronic device having an image receiving portion can include the following functions; a function to photograph a still image and a moving image; a function to automatically or manually adjust the photographed image; a function to store the photographed image in a recording medium (provided externally or incorporated in the camera); a function to display the photographed image on the display portion; and the like. Note that the functions that can be included in the electronic devices illustrated in FIGS. 12A to 12H and FIGS. 13A to 13D is not limited to these, and various functions can be included.

Electronic devices described in this embodiment mode are characterized by having a display portion in order to display some information. The electronic devices include a display portion which can display a uniform image because influence of variation in characteristics of a transistor is reduced.

Next, application examples of a semiconductor device are described.

Figure 13E:
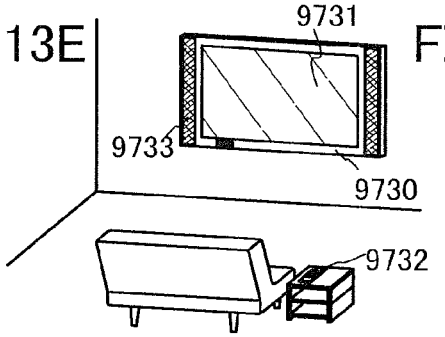

FIG. 13E illustrates an example where a semiconductor device is incorporated in a constructed object. FIG. 13E illustrates a housing 9730, a display portion 9731, a remote control device 9732 which is an operation portion, a speaker portion 9733, and the like. The semiconductor device is incorporated in the constructed object as a wall-hanging type and can be provided without requiring a large space.

Figure 13F:
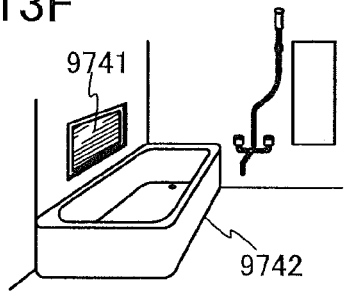

FIG. 13F illustrates another example where a semiconductor device is incorporated in a constructed object. A display panel 9741 is incorporated with a prefabricated bath 9742, and a person who takes a bath can view the display panel 9741.

Note that in this embodiment mode, a wall and a prefabricated bath are shown as examples of a constructed object; however, this embodiment mode is not limited thereto, and various constructed objects can be provided with a semiconductor device.

Next, examples in which a semiconductor device is incorporated in a moving object are described.

Figure 13G:
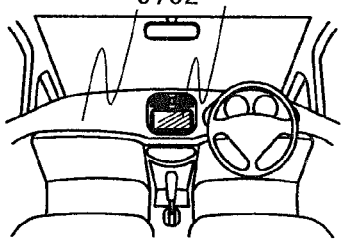

FIG. 13G illustrates an example in which a semiconductor device is incorporated with a car. A display panel 9761 is incorporated with a car body 9762, and can display an operation of the car body or information input from inside or outside the car body on demand. Note that a navigation function may be included.

Figure 13H:
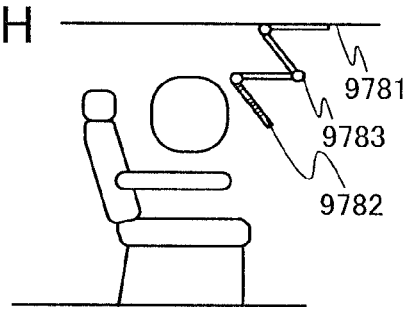

FIG. 13H illustrates an example in which a semiconductor device is incorporated with a passenger airplane. FIG. 13H illustrates a shape of a display panel 9782 attached to a ceiling 9781 above a seat of the passenger airplane when the display panel 9782 is used. The display panel 9782 is incorporated with the ceiling 9781 using a hinge portion 9783, and a passenger can view the display panel 9782 by stretching of the hinge portion 9783. The display panel 9782 has a function of displaying information by an operation of the passenger.

Note that in this embodiment mode, bodies of a car and an airplane are shown as a moving object; however, the example is not limited thereto, and a semiconductor device can be provided to various objects such as a motorcycle, a four-wheel vehicle (including a car, a bus, and the like), a train (including a monorail, a railroad car, and the like), and a vessel.

Note that the contents described with each drawing in this embodiment mode can be freely combined with or replaced with the contents described in another embodiment mode as appropriate.

This application is based on Japanese Patent Application serial No. 2008-054545 filed with Japan Patent Office on Mar. 5, 2008, the entire contents of which are hereby incorporated by reference.

What is claimed is:

1. A method for driving a semiconductor device comprising a first transistor, a second transistor, a third transistor, a fourth transistor, a fifth transistor, a capacitor element, a display element, a first wiring, and a second wiring, comprising:

in a first step, establishing a conducting state between the first wiring and a first electrode of the capacitor element through the first transistor, the second transistor and the fourth transistor when the third transistor and the fifth transistor are in off states;

in a second step, establishing a conducting state between the second wiring and the first electrode of the capacitor element through the first transistor, the third transistor and the fourth transistor when the second transistor and the fifth transistor are in off states; and in a third step, establishing a conducting state between the second wiring and the display element through the first transistor, the third transistor and the fifth transistor when the second transistor and the fourth transistor are in off states, wherein a first terminal of the first transistor is directly connected to the second transistor and the third transistor, wherein the second transistor is electrically connected to the first wiring, wherein the third transistor is electrically connected to the second wiring, wherein the fourth transistor is electrically connected to the first electrode of the capacitor element and a second terminal of the first transistor, wherein the fifth transistor is electrically connected to the display element and the second terminal of the first transistor, and wherein a gate of the first transistor is electrically connected to the first electrode of the capacitor element.

2. The method for driving a semiconductor device according to claim 1, wherein a second electrode of the capacitor element is electrically connected to the second wiring.

3. The method for driving a semiconductor device according to claim 1, wherein the second wiring is a signal line.

4. A method for driving a semiconductor device comprising a first transistor, a second transistor, a third transistor, a fourth transistor, a fifth transistor, a sixth transistor, a capacitor element, a display element, a first wiring, a second wiring, and a third wiring, comprising:

in a first step, establishing a conducting state between a first electrode of the capacitor element and the third wiring through the sixth transistor when the first transistor, the second transistor, the third transistor, the fourth transistor and the fifth transistor are in off states;

in a second step, establishing a conducting state between the first wiring and the first electrode of the capacitor element through the first transistor, the second transistor and the fourth transistor when the third transistor, the fifth transistor and the sixth transistor are in off states;

in a third step, establishing a conducting state between the second wiring and the first electrode of the capacitor element through the first transistor, the third transistor and the fourth transistor when the second transistor, the fifth transistor and the sixth transistor are in off states; and in a fourth step, establishing a conducting state between the second wiring and the display element through the first transistor, the third transistor and the fifth transistor when the second transistor, the fourth transistor and the sixth transistor are in off states, wherein a first terminal of the first transistor is directly connected to the second transistor and the third transistor, wherein the second transistor is electrically connected to the first wiring, wherein the third transistor is electrically connected to the second wiring, wherein the fourth transistor is electrically connected to the first electrode of the capacitor element and a second terminal of the first transistor, wherein the fifth transistor is electrically connected to the display element and the second terminal of the first transistor, wherein the sixth transistor is electrically connected to the first electrode of the capacitor element and the third wiring, and wherein a gate of the first transistor is electrically connected to the first electrode of the capacitor element.

5. The method for driving a semiconductor device according to claim 4, wherein a second electrode of the capacitor element is electrically connected to the second wiring.

6. The method for driving a semiconductor device according to claim 4, wherein the second wiring is a signal line.

* * * * *

UNITED STATES PATENT AND TRADEMARK OFFICE

CERTIFICATE OF CORRECTION

PATENT NO. : 8,791,929 B2
APPLICATION NO. : 13/647469
DATED : July 29, 2014
INVENTOR(S) : Hajime Kimura It is certified that error appears in the above-identified patent and that said Letters Patent is hereby corrected as shown below:

In the Specification

Column 12, line 46 – after "timing" replace ";" with --:--; and

Column 31, line 48 – replace "Loft" with --Loff--.

Signed and Sealed this
Second Day of June, 2015

Michelle K. Lee

Michelle K. Lee
*Director of the United States Patent and Trademark Office*